US009718636B2

(12) United States Patent
Tanaka

(10) Patent No.: US 9,718,636 B2
(45) Date of Patent: Aug. 1, 2017

(54) TAPE CARTRIDGE

(71) Applicant: Mitsugi Tanaka, Nagoya (JP)

(72) Inventor: Mitsugi Tanaka, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 227 days.

(21) Appl. No.: 14/025,888

(22) Filed: Sep. 13, 2013

(65) Prior Publication Data

US 2014/0084103 A1 Mar. 27, 2014

(30) Foreign Application Priority Data

Sep. 27, 2012 (JP) ..... 2012-214825

(51) Int. Cl.
*B65H 37/00* (2006.01)
*B41J 15/04* (2006.01)
(Continued)

(52) U.S. Cl.
CPC ..... *B65H 37/00* (2013.01); *B41J 15/044* (2013.01); *B65H 18/028* (2013.01);
(Continued)

(58) Field of Classification Search
CPC ..... B65H 2801/12; B65H 2301/51122; B65H 37/00; B65H 18/028; B65H 18/103; B65H 2301/41308; B65H 2301/46017; B65H 2402/543; B65H 2701/11332; B65H 2301/41346
See application file for complete search history.

(56) References Cited

U.S. PATENT DOCUMENTS 5,961,229 A 10/1999 Kameyama
5,984,546 A 11/1999 Kameyama
(Continued)

FOREIGN PATENT DOCUMENTS

CN 1165744 11/1997
CN 1528596 9/2004
(Continued)

OTHER PUBLICATIONS

Chinese Office Action issued in 2013104513399 on Jun. 18, 2015.
(Continued)

*Primary Examiner* — William A Rivera
(74) *Attorney, Agent, or Firm* — McCarter & English, LLP

(57) ABSTRACT

The disclosure discloses a tape cartridge comprising a first tape roll, a second tape roll, a connecting part, and a pair of gripped parts. A first tape consumed by feed-out is wound around the first tape roll. The second tape roll winds a second tape around an axis extending along the first direction and provided on a downstream side of the first tape roll. The second tape is generated by a feeding of the first tape. The connecting part is provided so as to connect the first tape roll and the second tape roll. The pair of gripped parts extends along the second direction, each respectively provided on either side of the connecting part along the first direction. The gripped part comprises a slip preventing part configured to prevent slipping during gripping on an end of the gripped part in the one side along the second direction.

5 Claims, 29 Drawing Sheets

(51) Int. Cl.
*B65H 18/02* (2006.01)
*B65H 18/10* (2006.01)

(52) U.S. Cl.
CPC . *B65H 18/103* (2013.01); *B65H 2301/41308* (2013.01); *B65H 2301/41346* (2013.01); *B65H 2301/51122* (2013.01); *B65H 2402/543* (2013.01); *B65H 2701/11332* (2013.01); *B65H 2801/12* (2013.01)

(56) References Cited

U.S. PATENT DOCUMENTS

| | | | | |
|---|---|---|---|---|
| 6,079,886 | A | 6/2000 | Kameyama | |
| 6,132,119 | A * | 10/2000 | Nakajima | B41J 3/4075 400/207 |
| 7,967,516 | B2 * | 6/2011 | Mistyurik | B41J 29/02 400/619 |
| 8,845,219 | B2 * | 9/2014 | Tanaka | B41F 17/10 400/605 |
| 8,905,661 | B2 * | 12/2014 | Kosuge | B65H 20/02 400/611 |
| 9,067,441 | B2 * | 6/2015 | Tanaka | B41J 11/22 |
| 2009/0317161 | A1 | 12/2009 | Vo et al. | |
| 2012/0027486 | A1 | 2/2012 | Suva et al. | |
| 2013/0272767 | A1 * | 10/2013 | Tanaka | B41J 15/042 400/578 |
| 2013/0292060 | A1 * | 11/2013 | Tanaka | B65H 49/00 156/538 |
| 2013/0292061 | A1 * | 11/2013 | Tanaka | B65H 49/00 156/538 |
| 2013/0336699 | A1 | 12/2013 | Vo et al. | |
| 2015/0053351 | A1 * | 2/2015 | Tanaka | B41J 15/044 156/538 |
| 2015/0077498 | A1 | 3/2015 | Vo et al. | |

FOREIGN PATENT DOCUMENTS

| | | |
|---|---|---|
| CN | 102083630 | 6/2011 |
| EP | 0805042 | 11/1997 |
| EP | 2 093 071 | 8/2009 |
| EP | 2 660 062 | 11/2013 |
| JP | 58166091 | 10/1983 |
| JP | H01-74149 | 5/1989 |
| JP | H03-49971 | 3/1991 |
| JP | 0577824 | 3/1993 |
| JP | 10193651 | 7/1998 |
| JP | H10-193733 | 7/1998 |
| JP | H10-193760 | 7/1998 |
| JP | H1120253 | 1/1999 |
| JP | 2002167084 | 6/2002 |
| JP | 2006159413 | 6/2006 |
| JP | 2007-230156 | 9/2007 |
| JP | 2009-214433 | 9/2009 |
| JP | 2009-298095 | 12/2009 |
| WO | 2009155482 | 12/2009 |

OTHER PUBLICATIONS

European Search Report issued in Application No. 13184975.4 on Jan. 13, 2014.
Japanese Office Action issued in 2012-214825 on Jun. 21, 2016.

* cited by examiner

[FIG. 1]
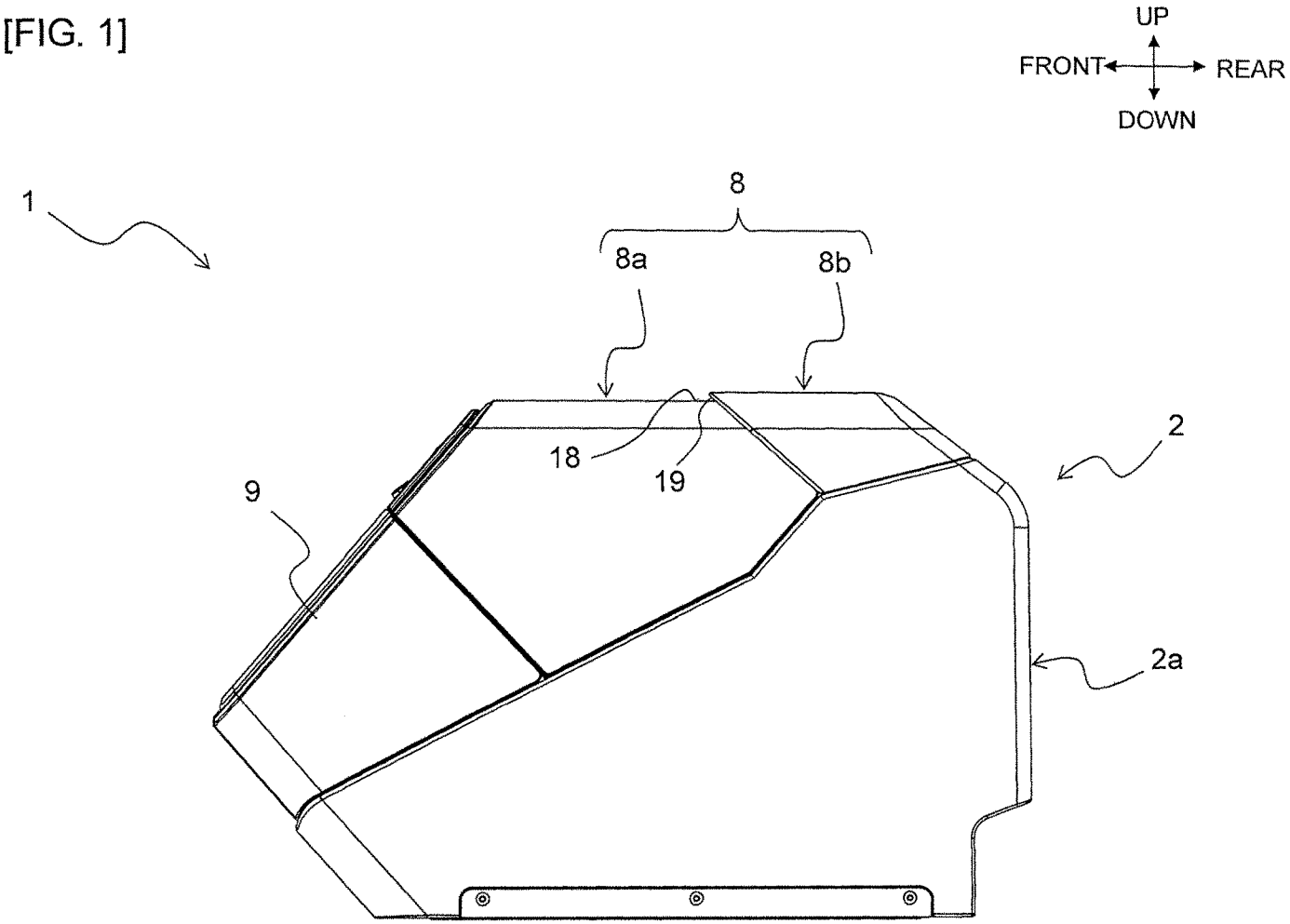

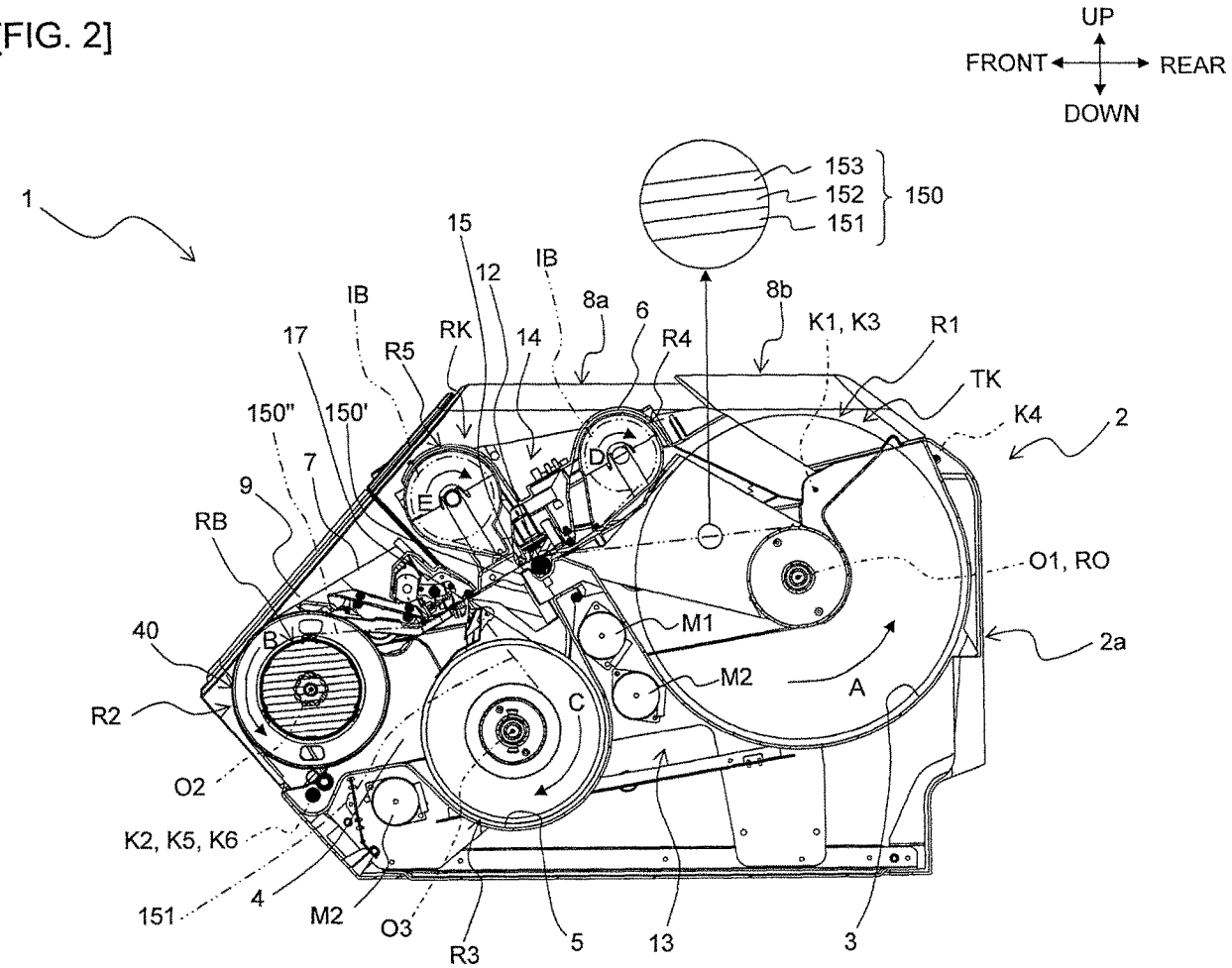
[FIG. 2]

[FIG. 3]
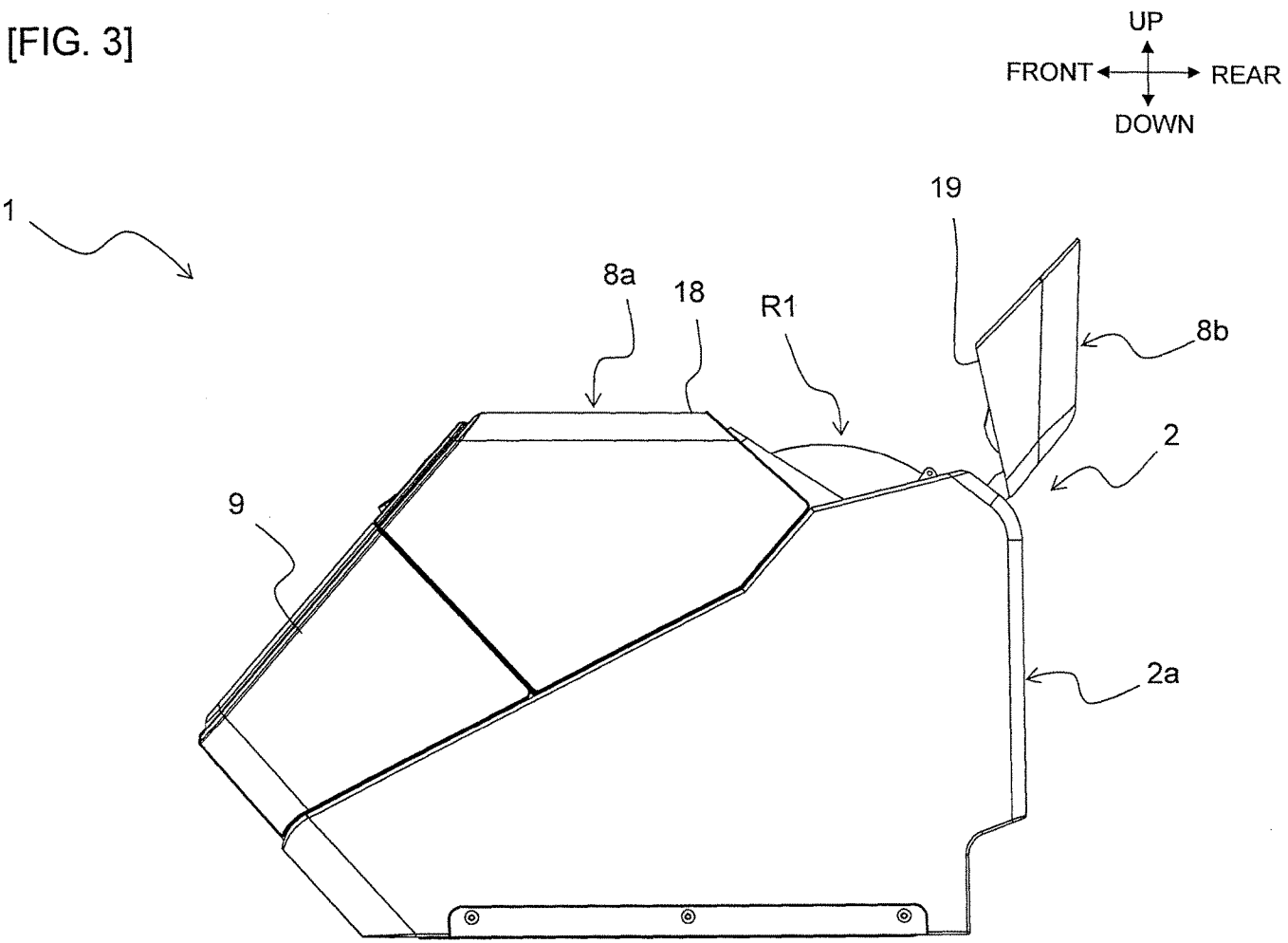

[FIG. 4]
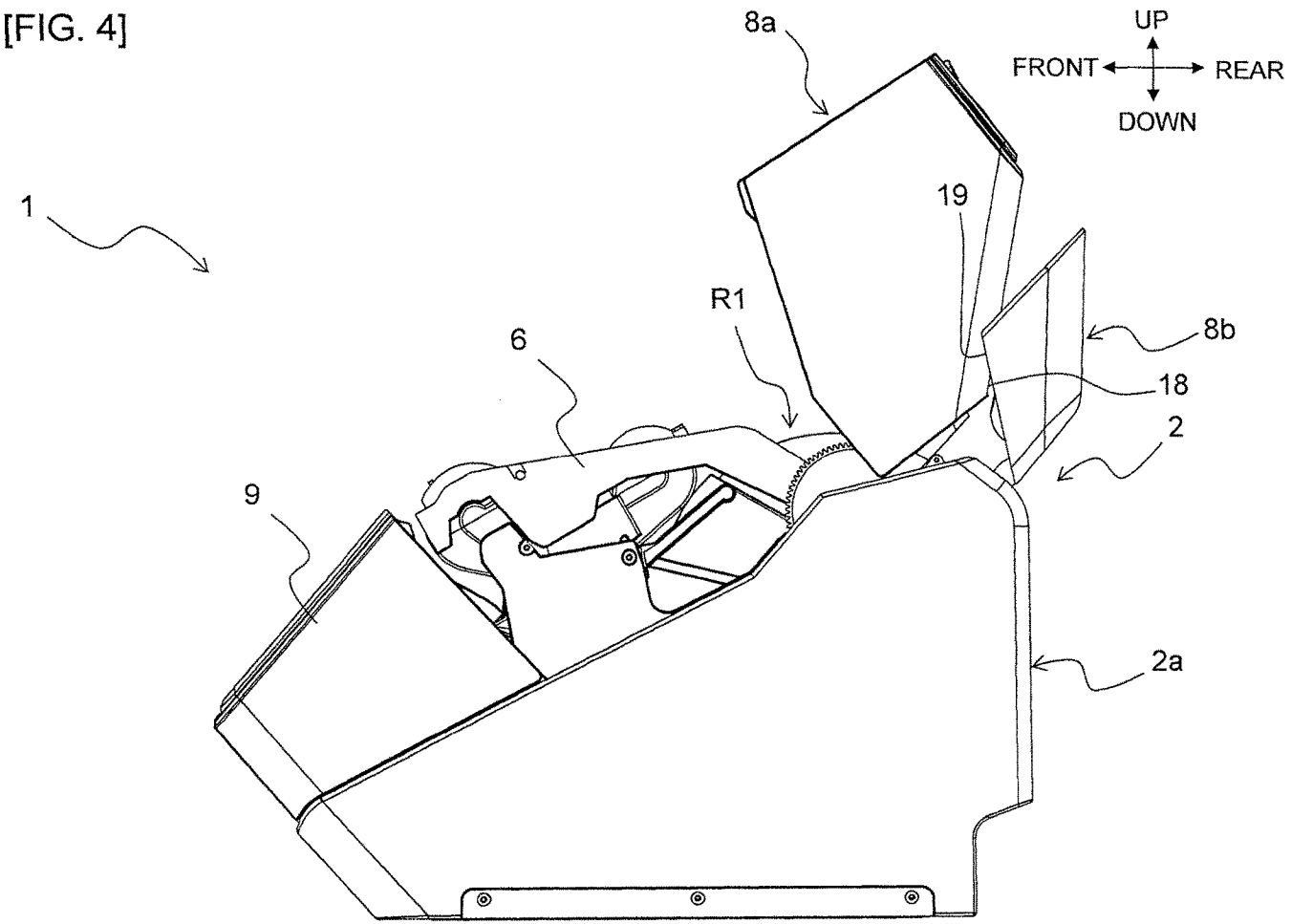

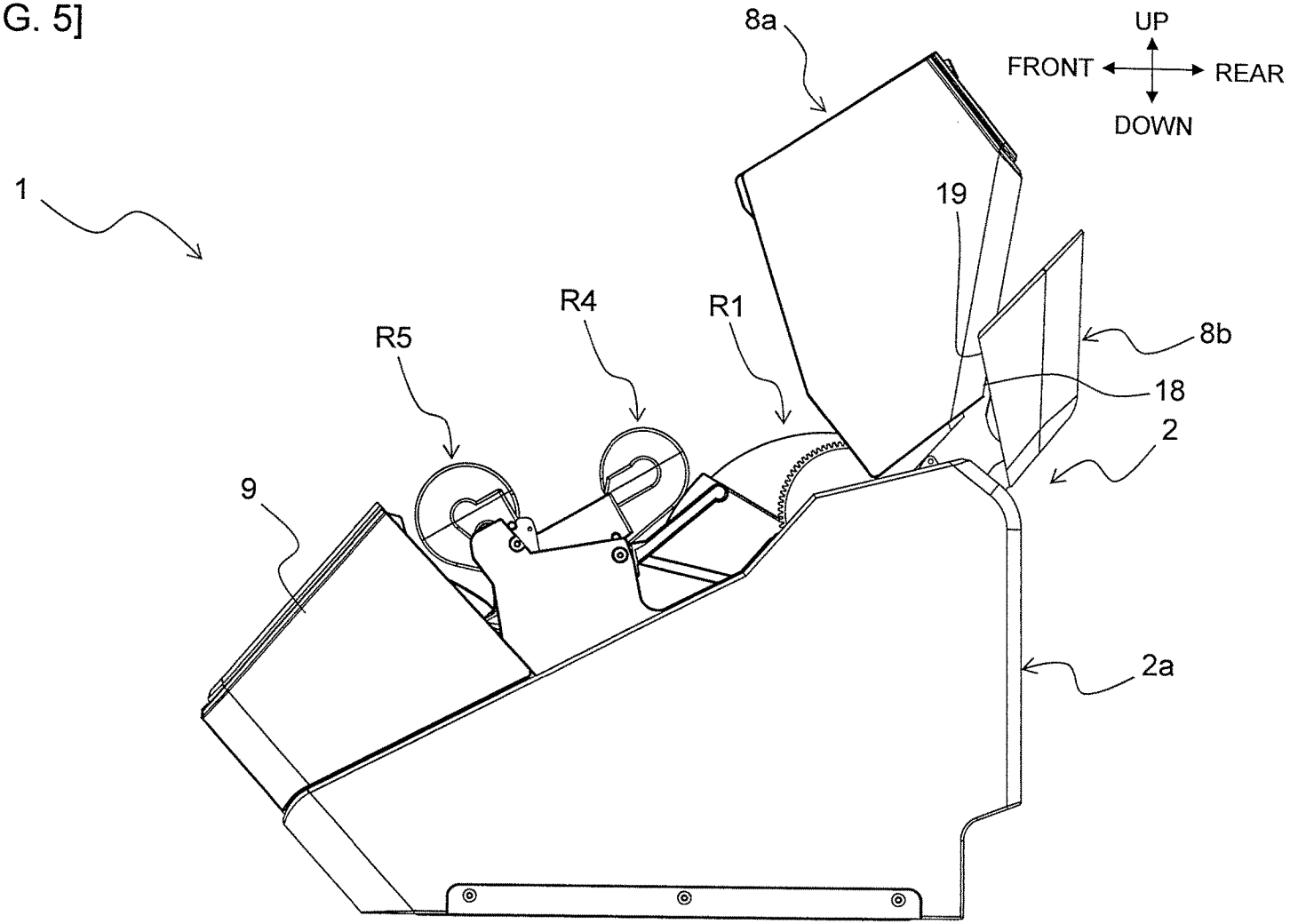
[FIG. 5]

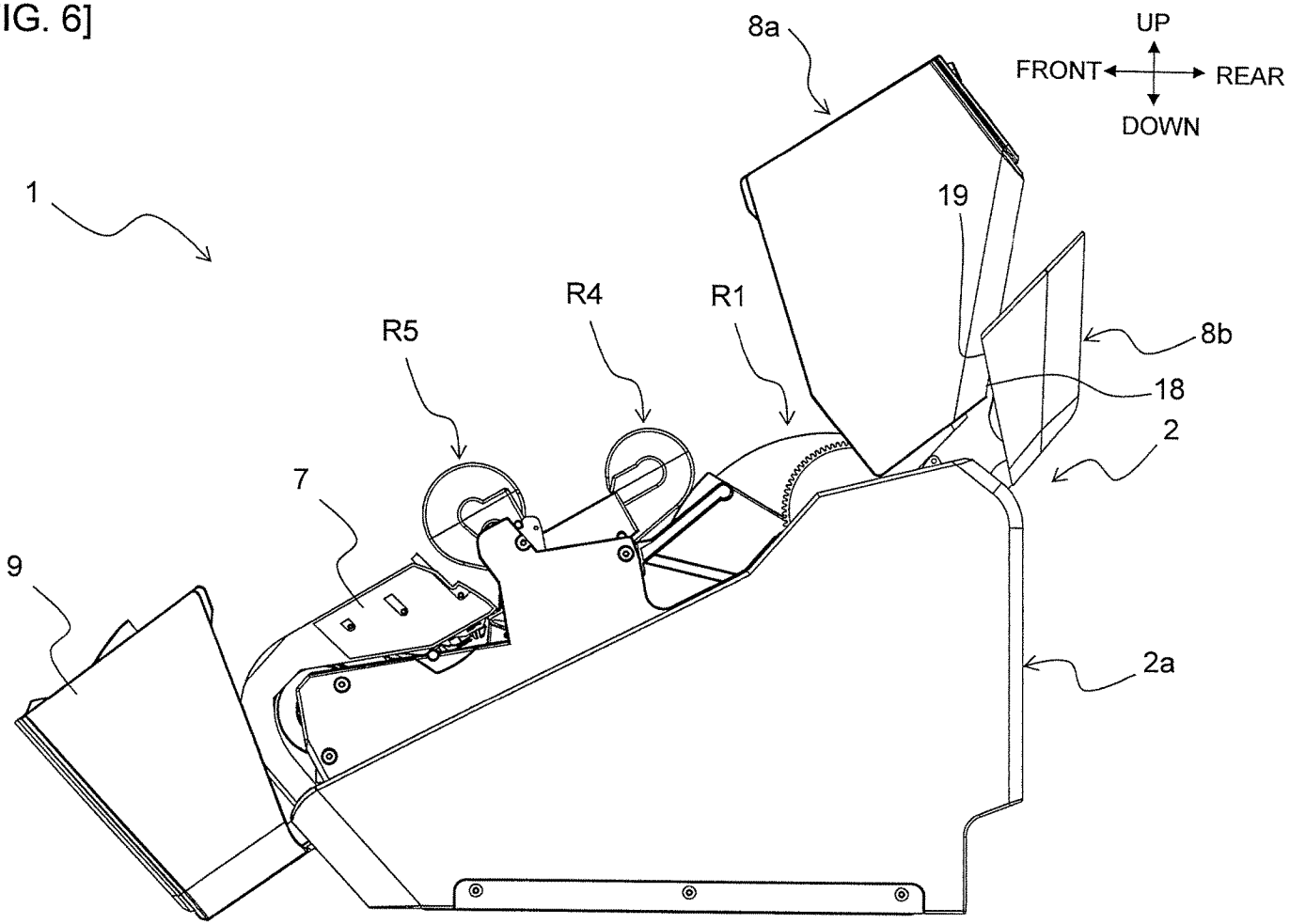
[FIG. 6]

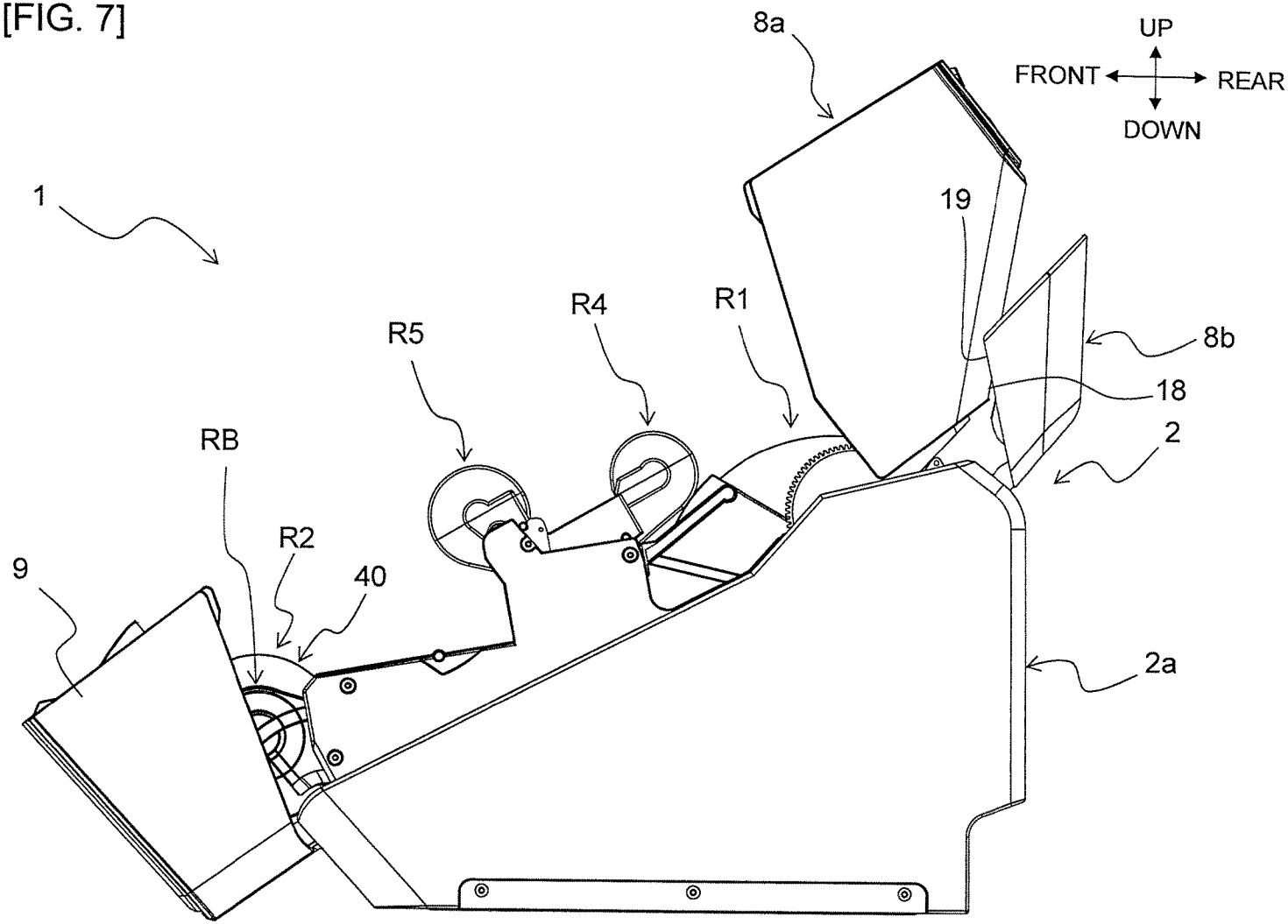
[FIG. 7]

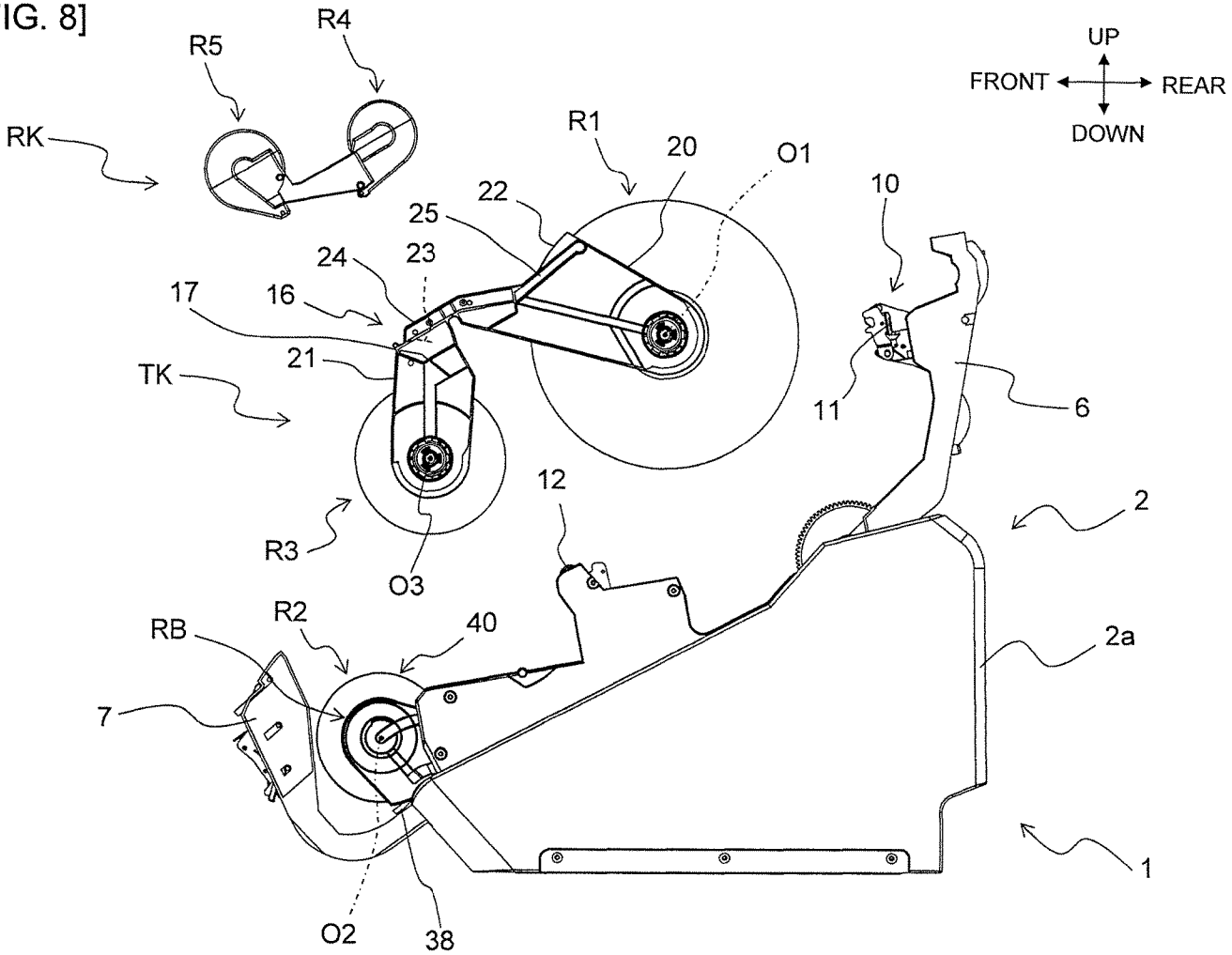
[FIG. 8]

[FIG. 9]
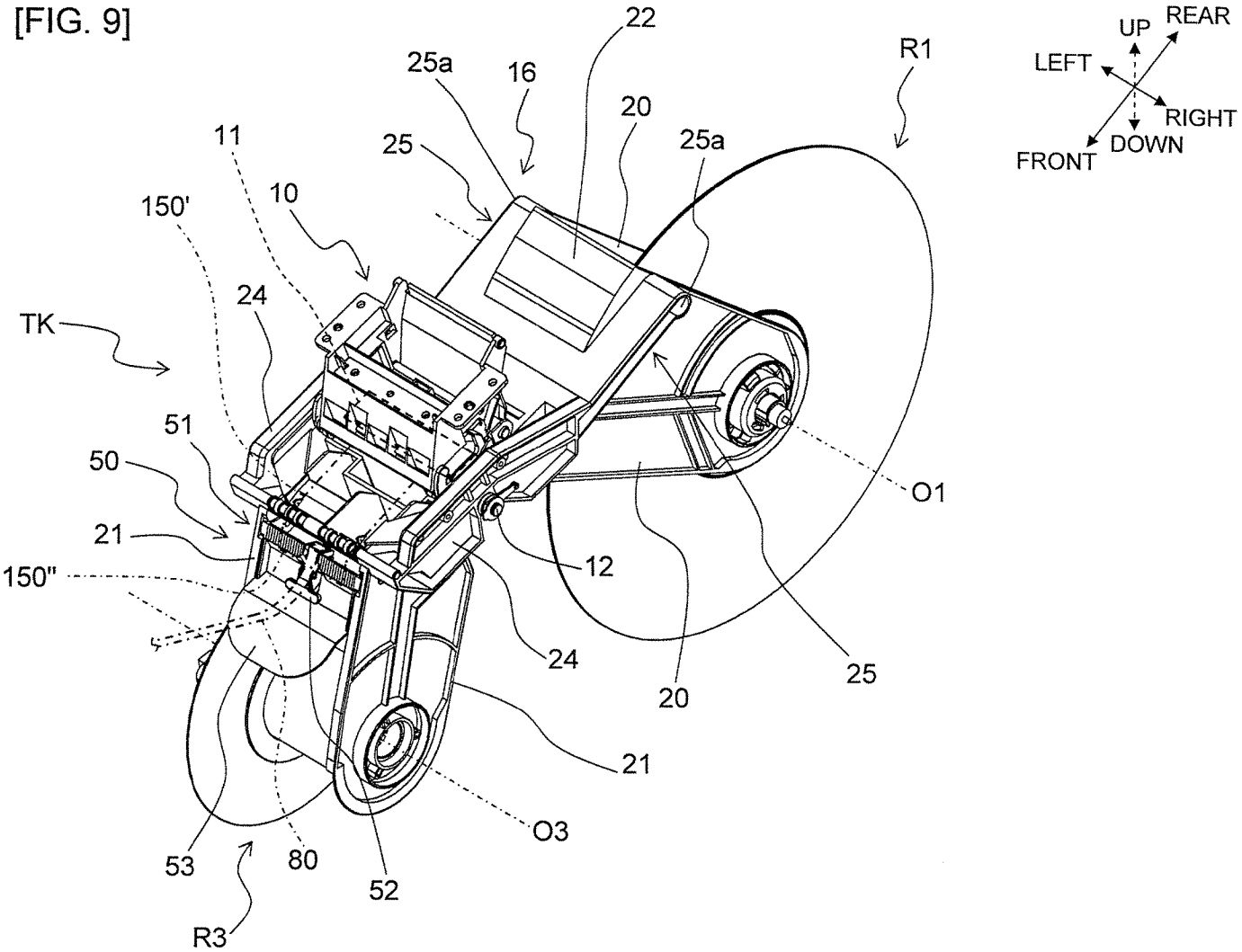

[FIG. 10]
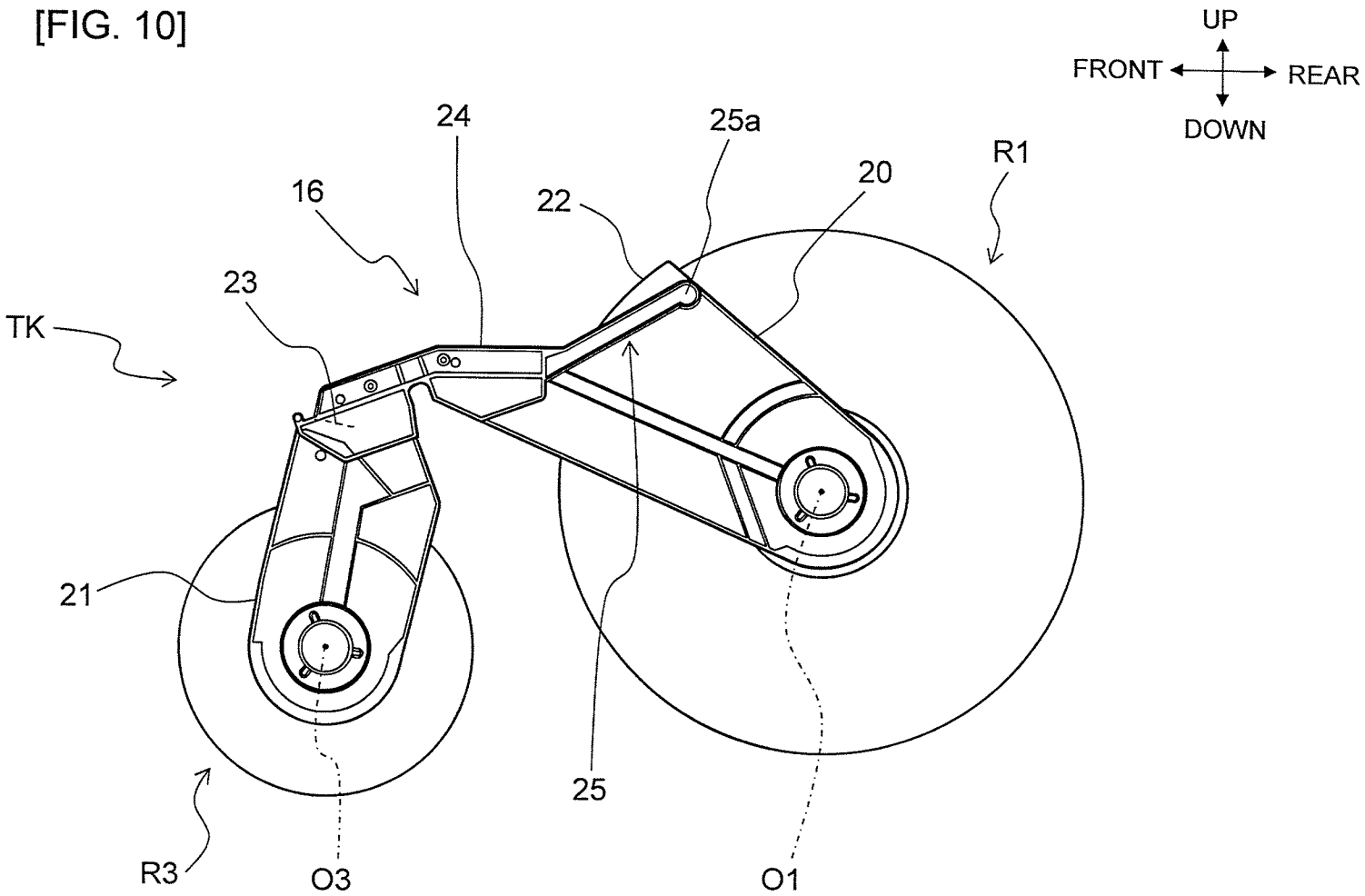

[FIG. 11]
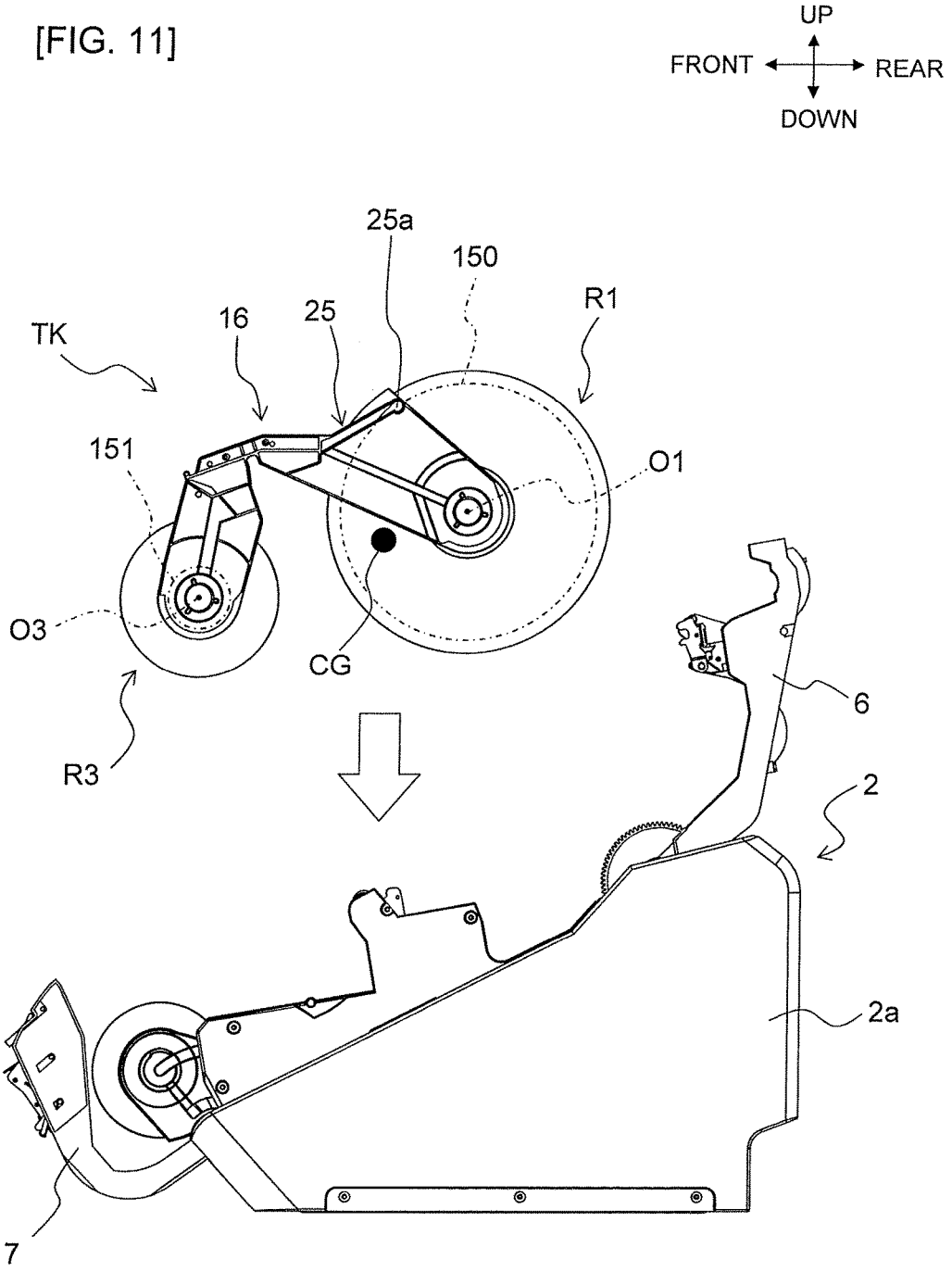

[FIG. 12]
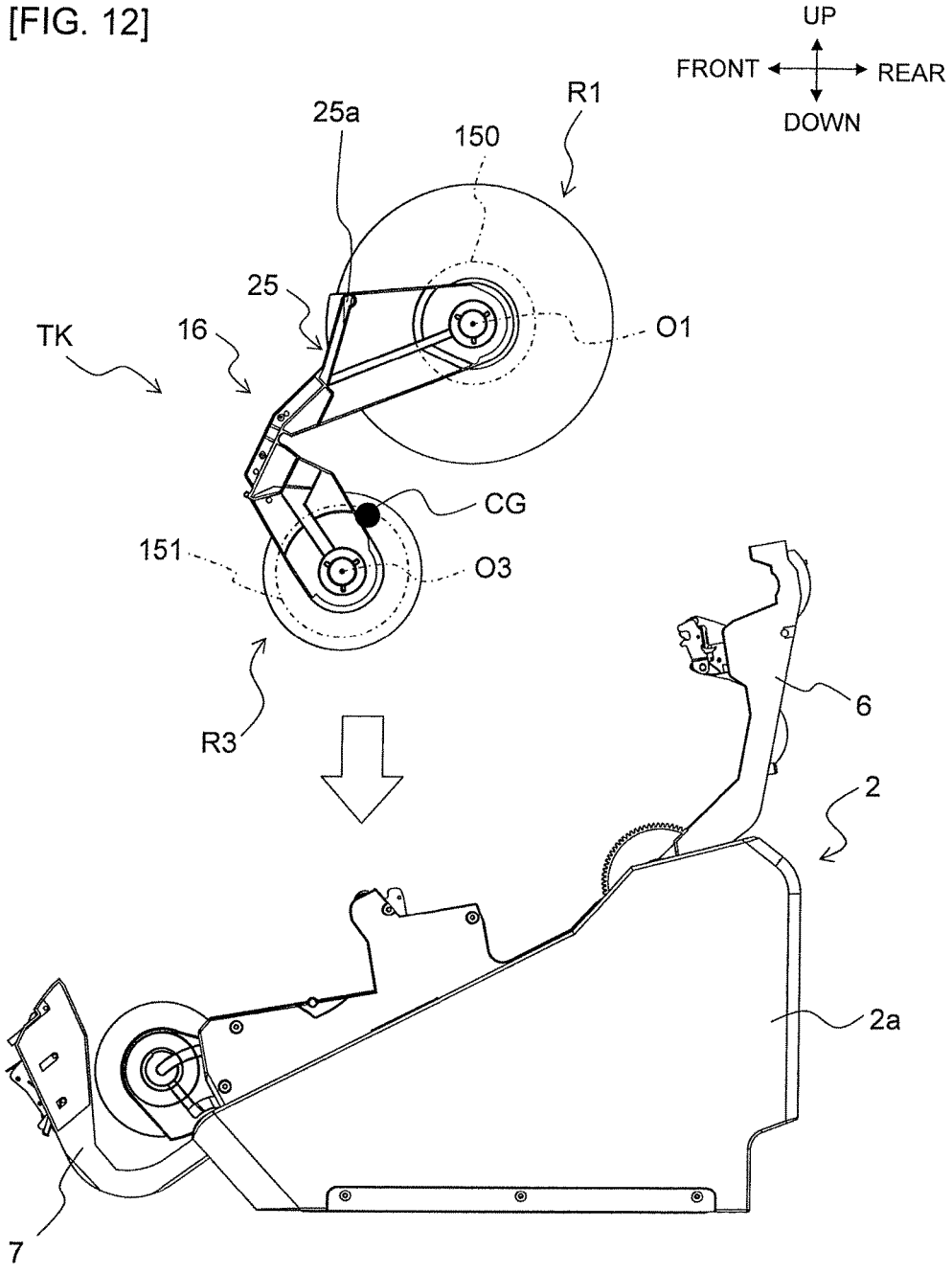

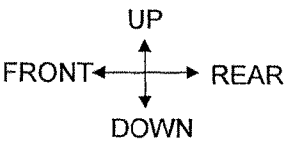
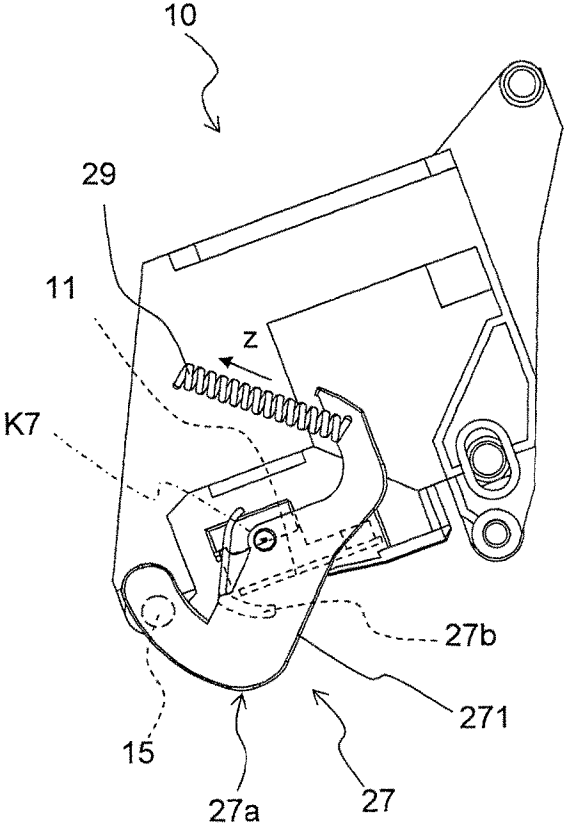
[FIG. 13B]
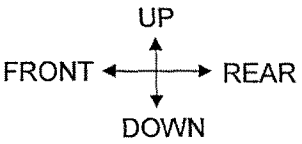
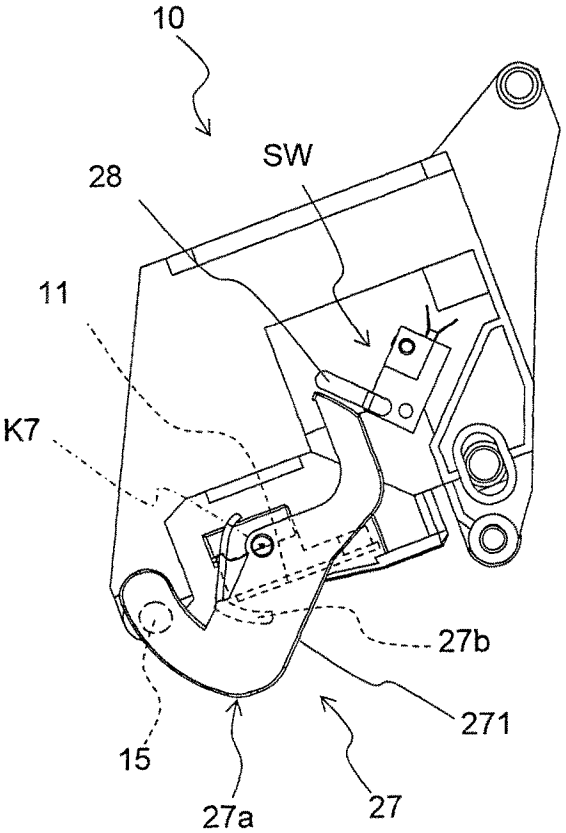
[FIG. 13A]

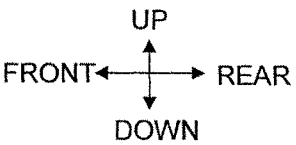
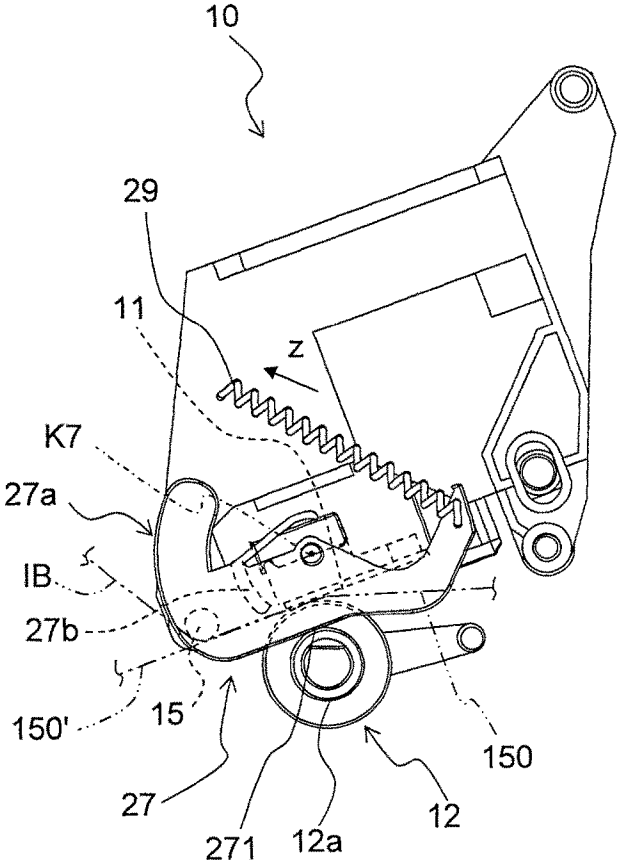
[FIG. 14B]
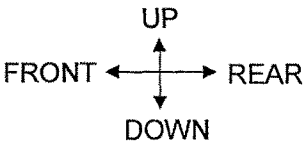
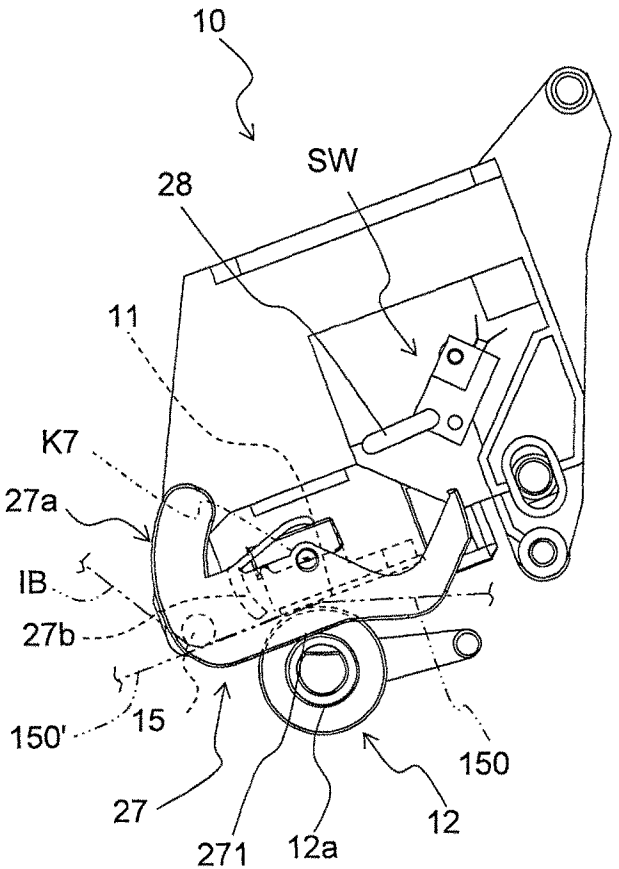
[FIG. 14A]

[FIG. 15]
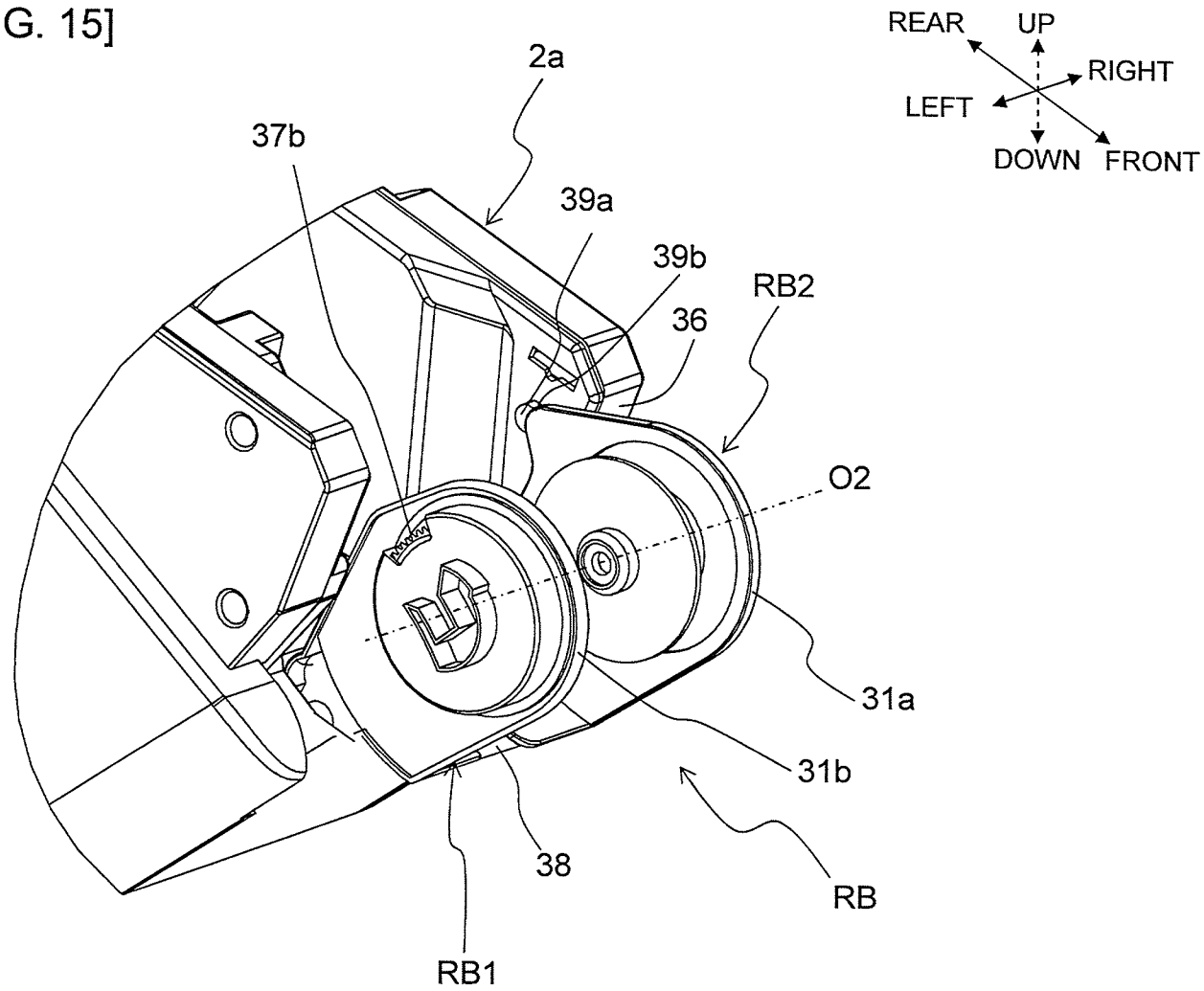

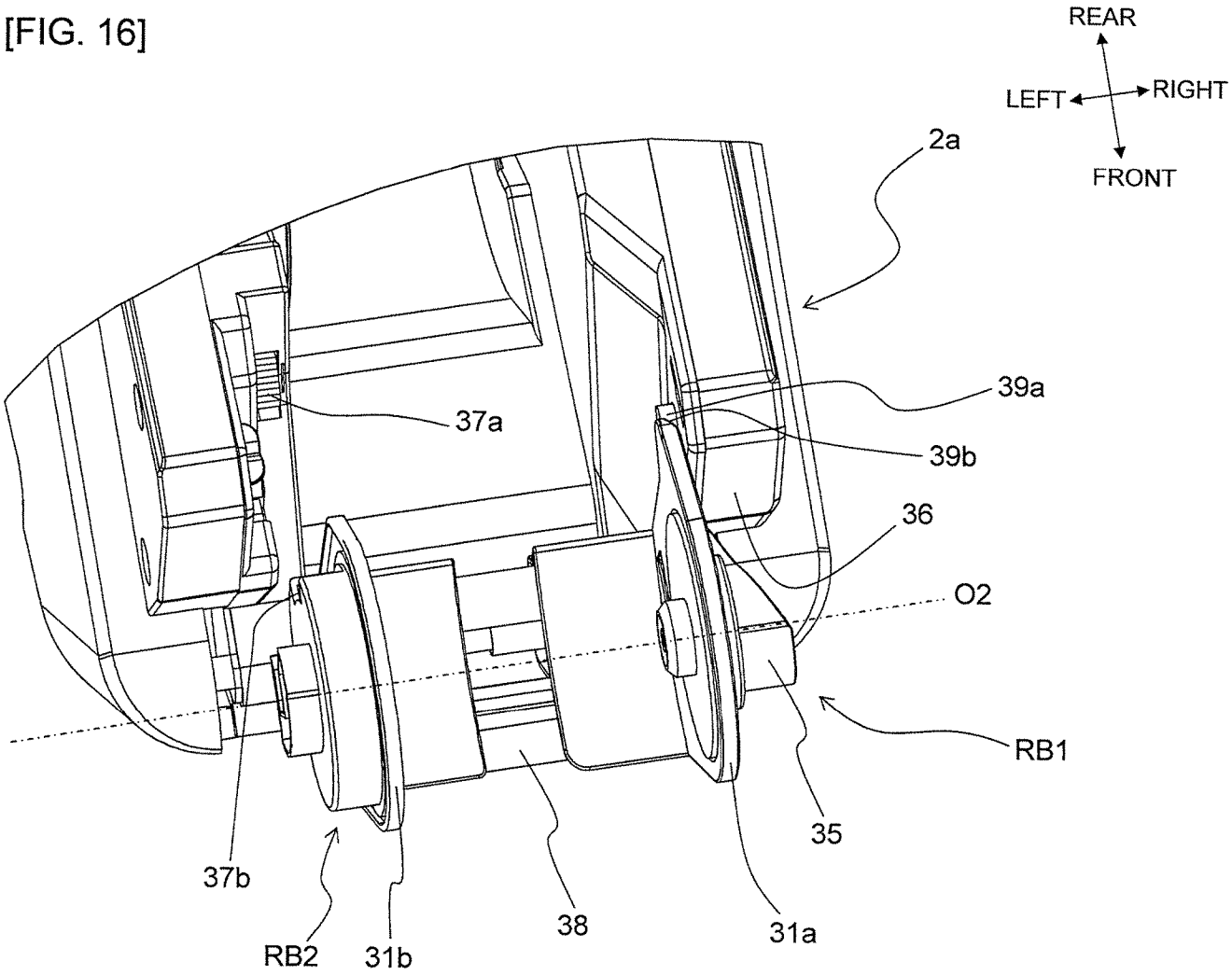
[FIG. 16]

[FIG. 17]
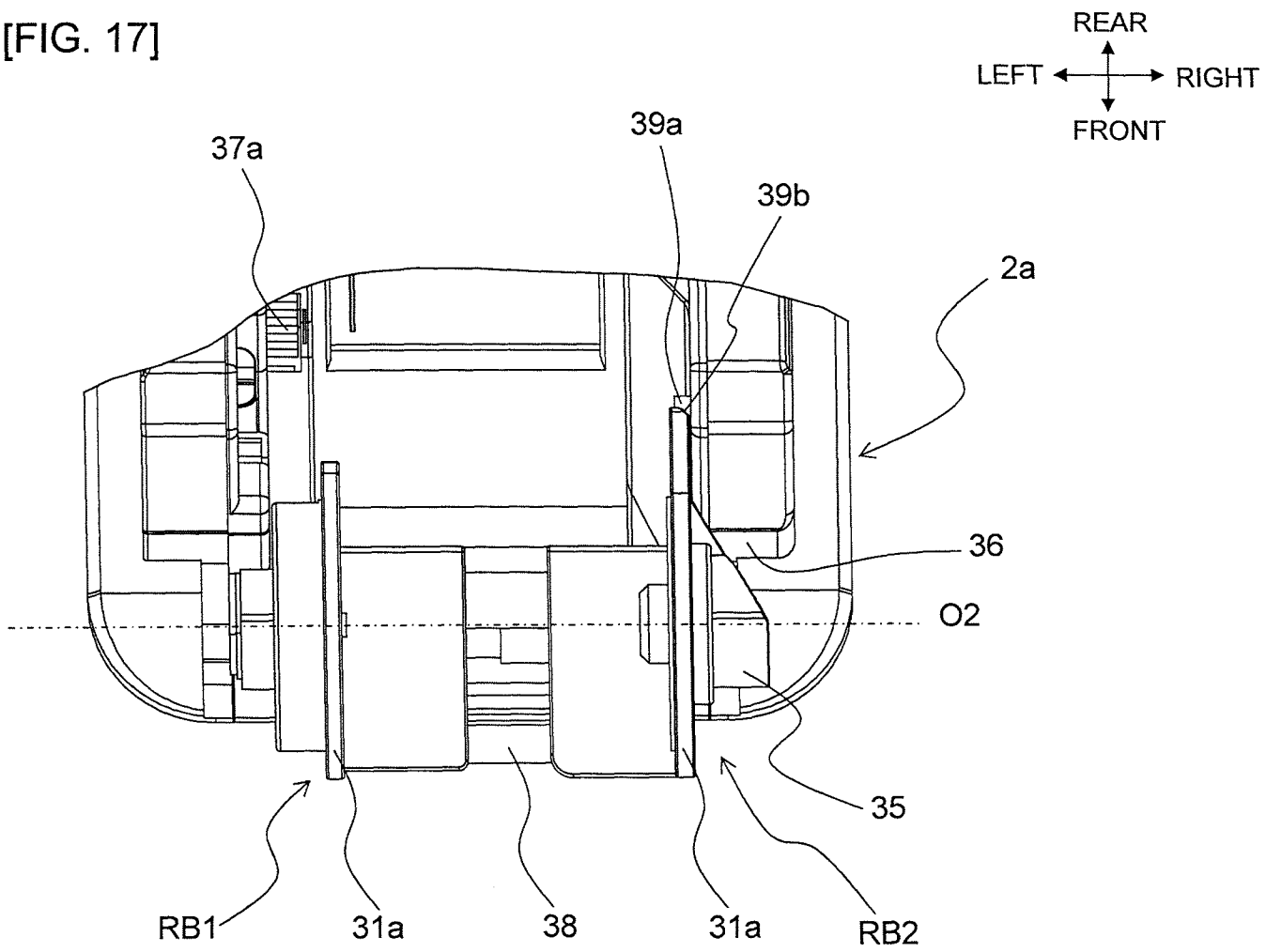

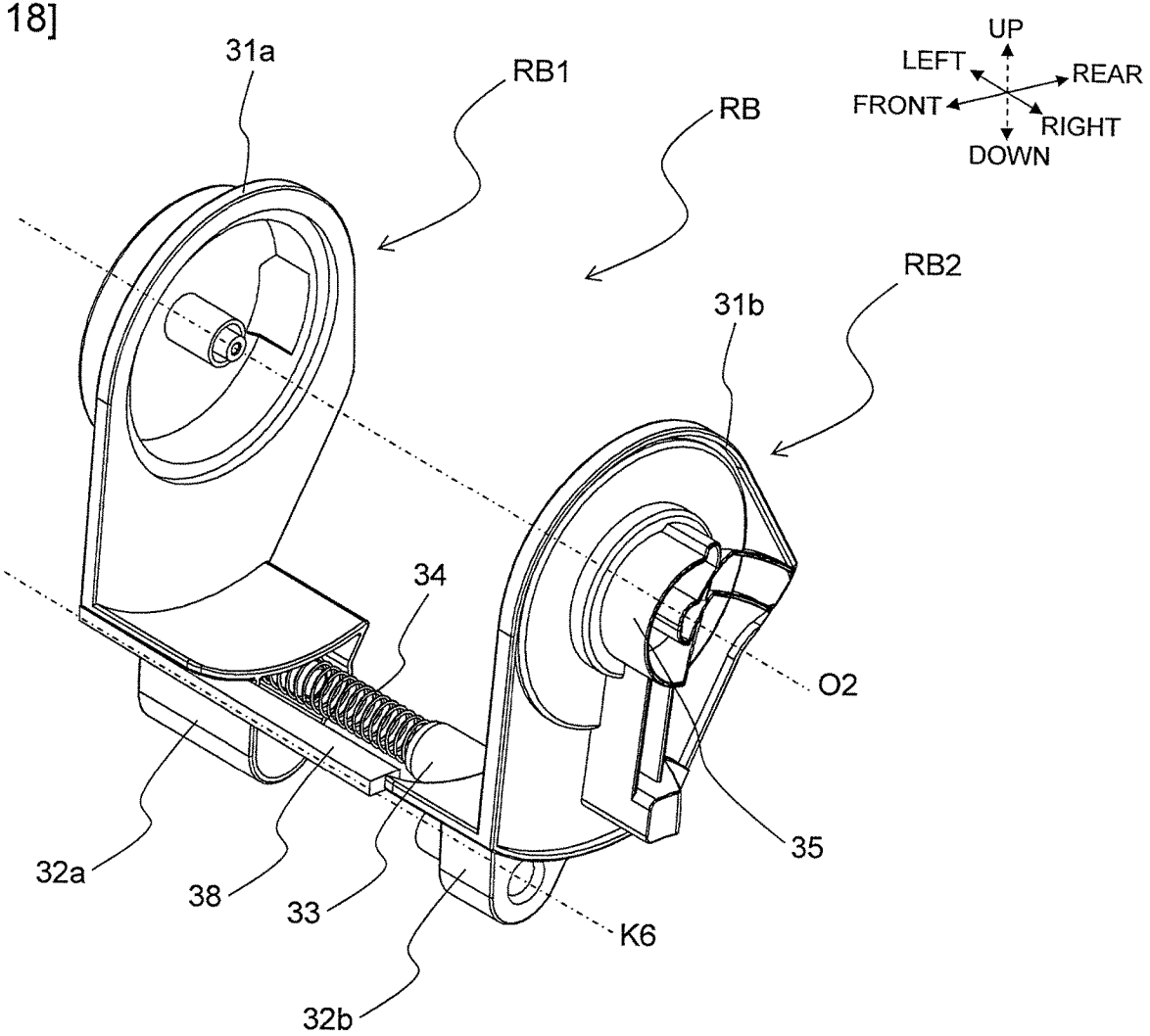
[FIG. 18]

[FIG. 19]
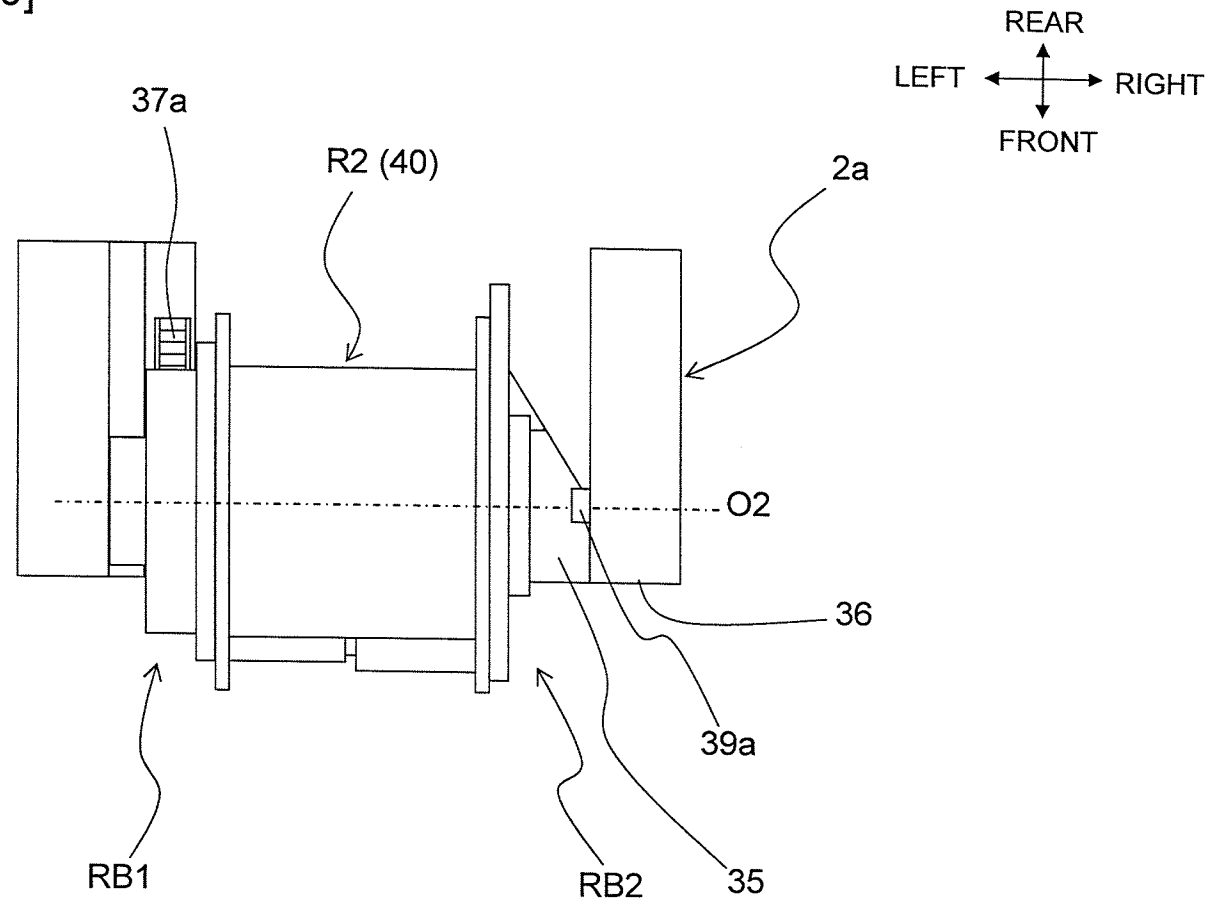

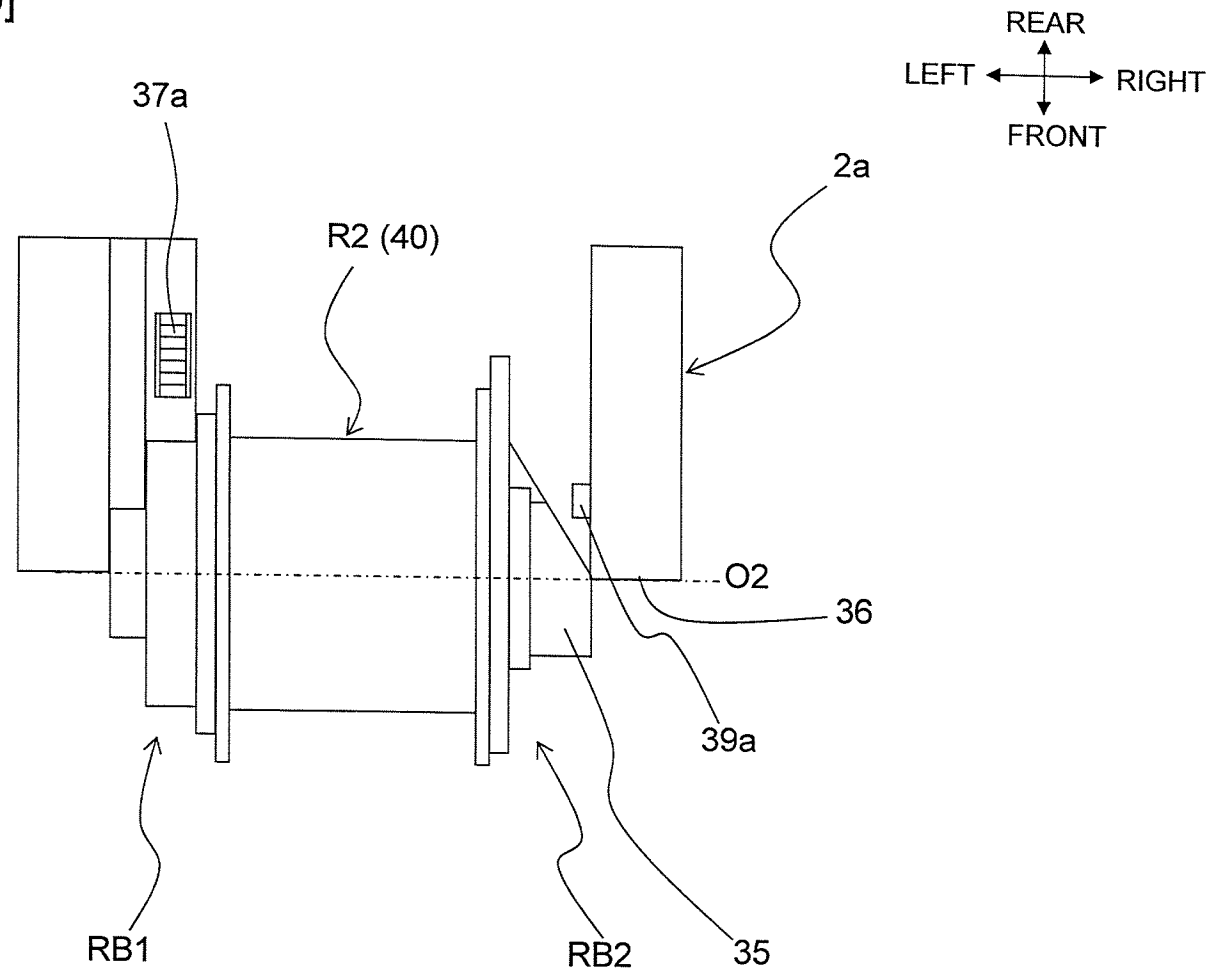
[FIG. 20]

[FIG. 21]
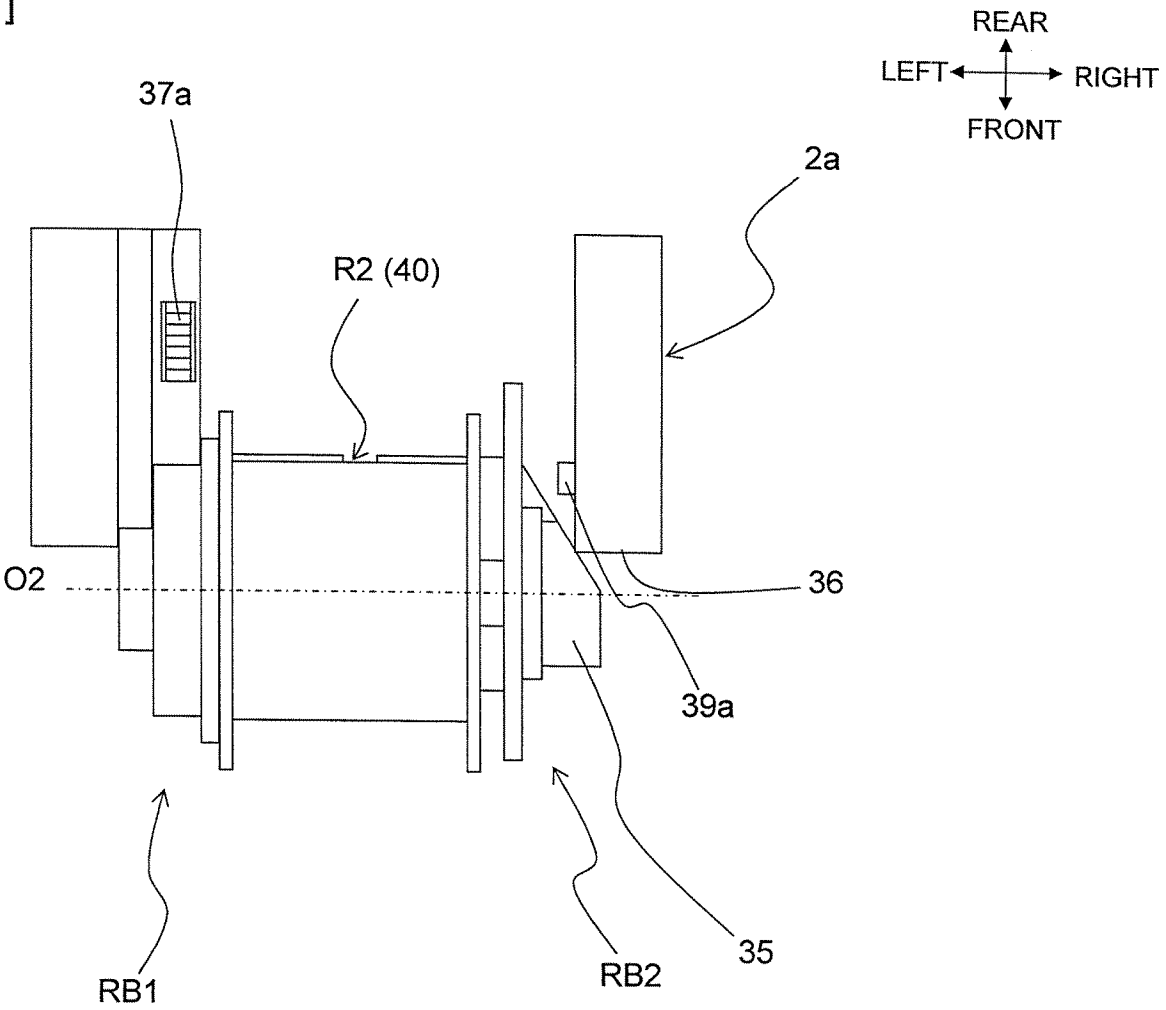

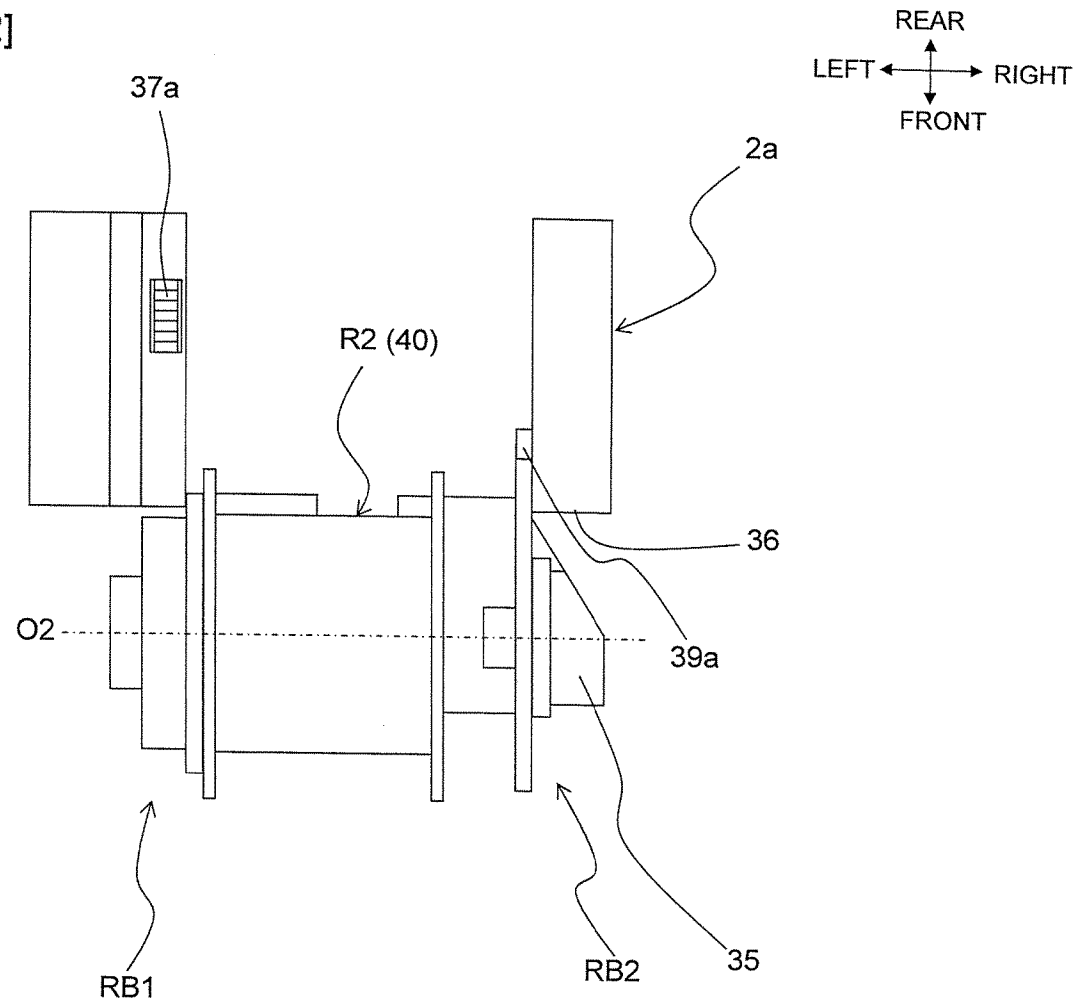
[FIG. 22]

[FIG. 23]
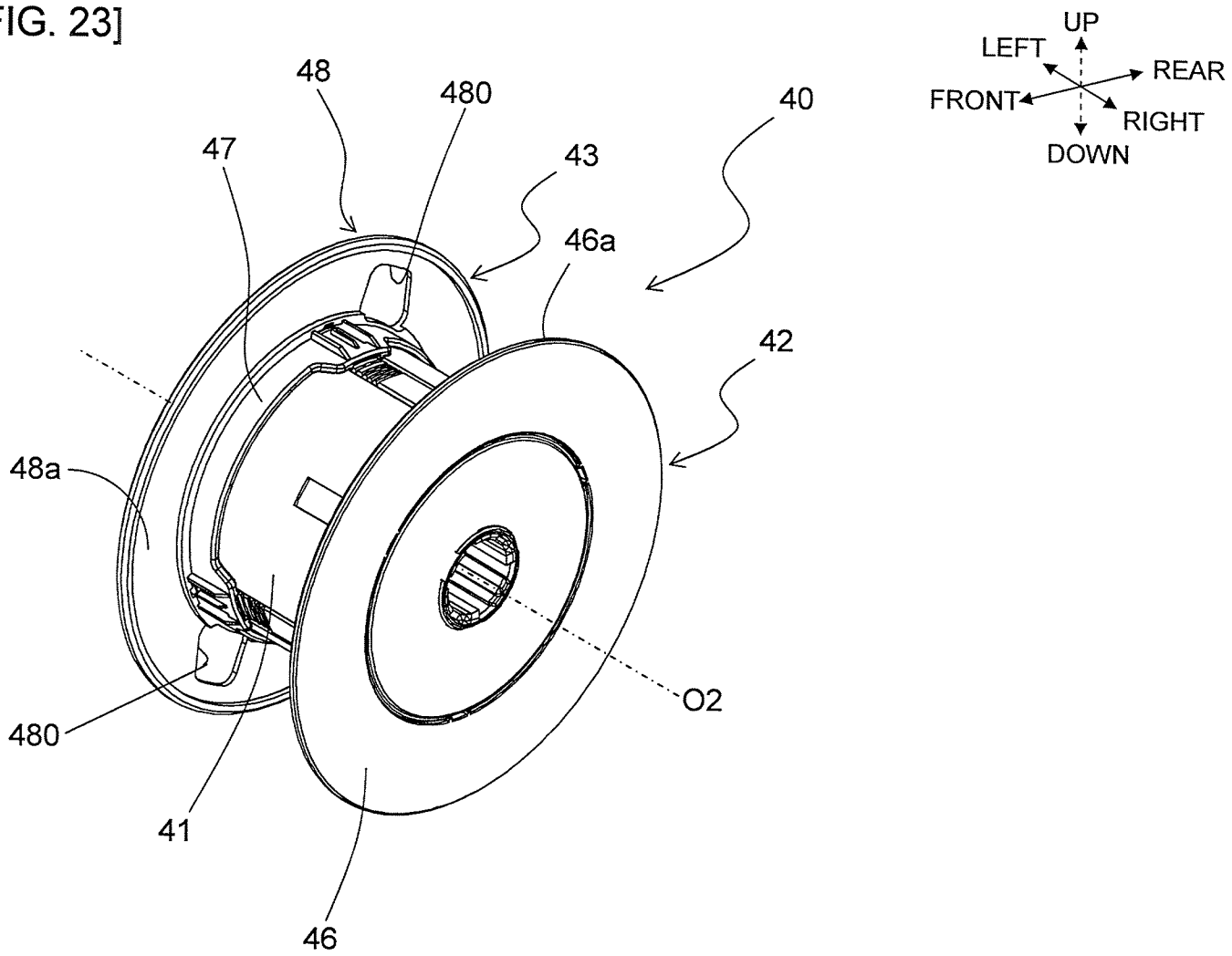

[FIG. 24]
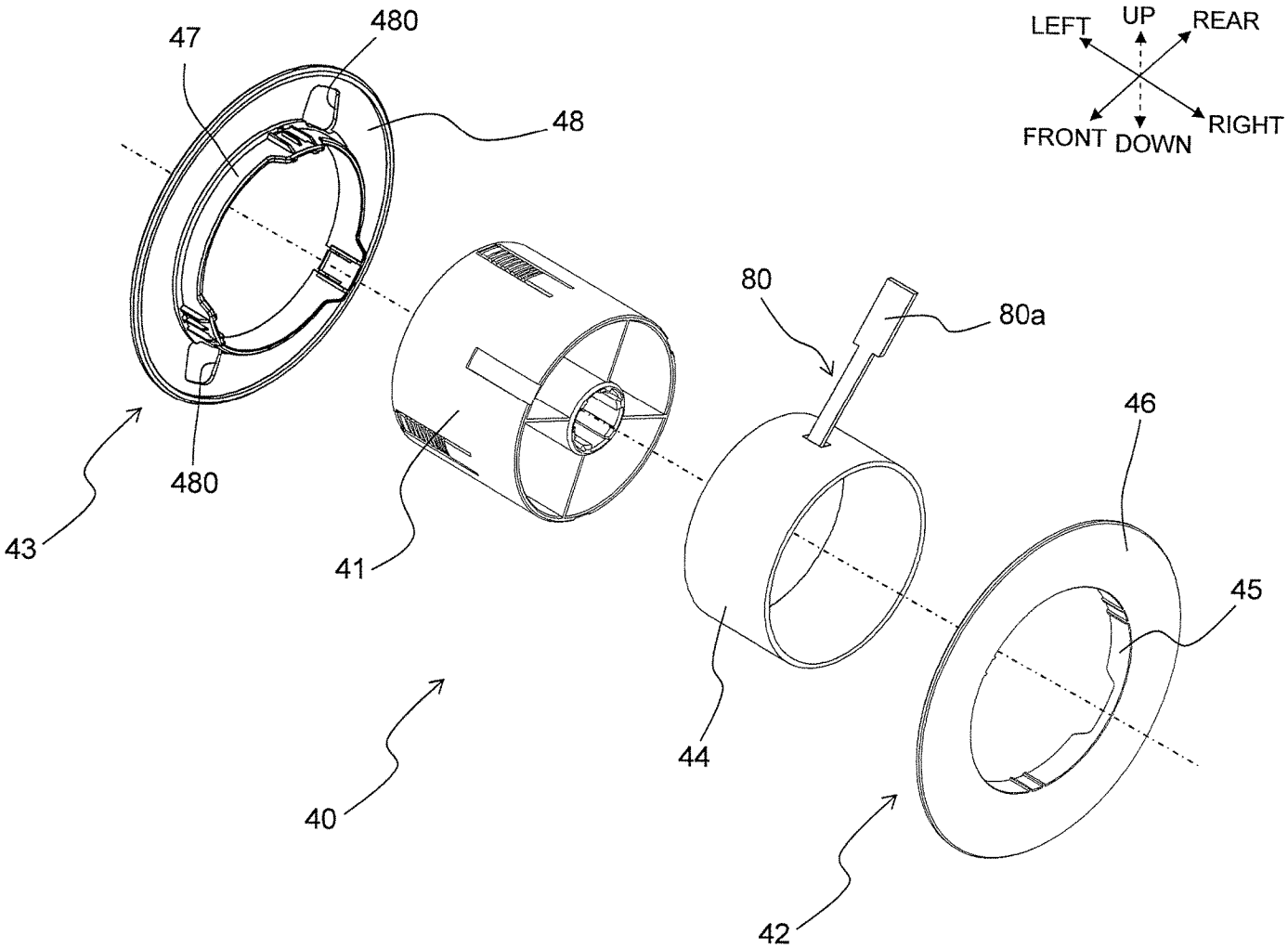

[FIG. 25]
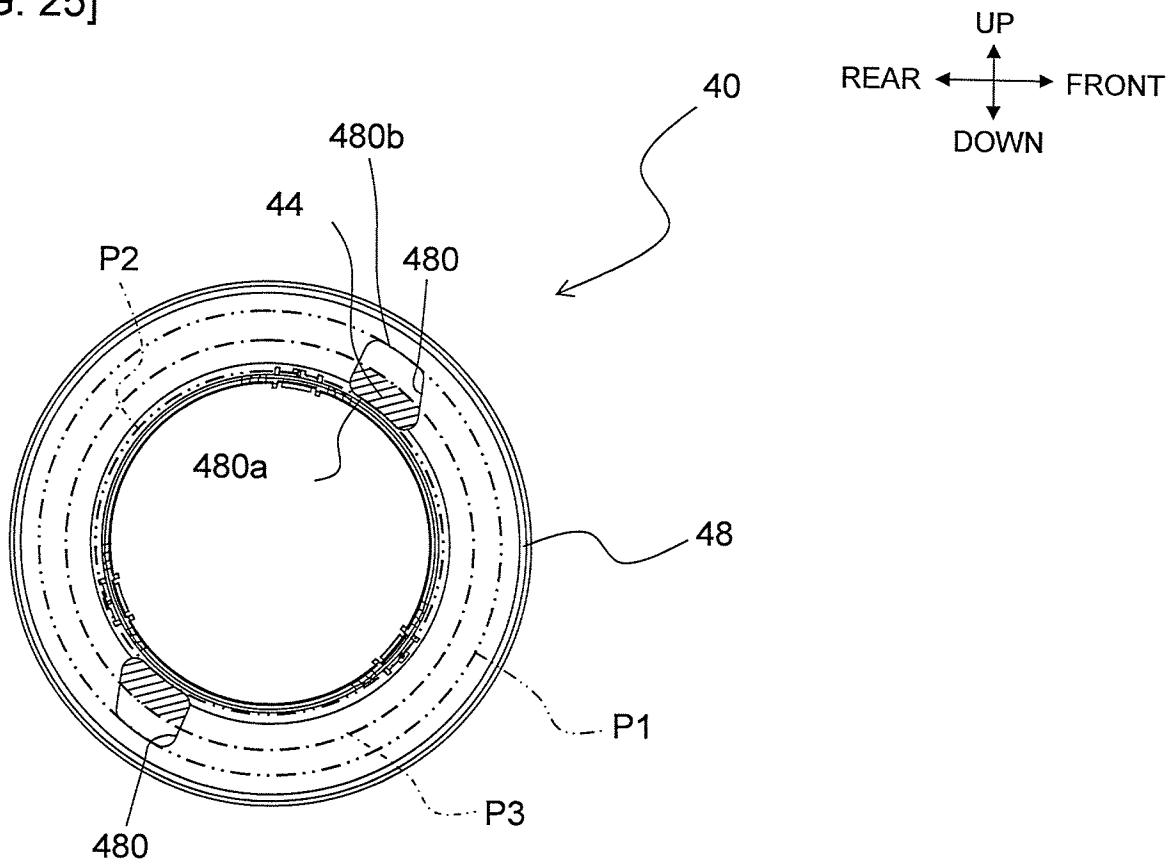

[FIG. 26]
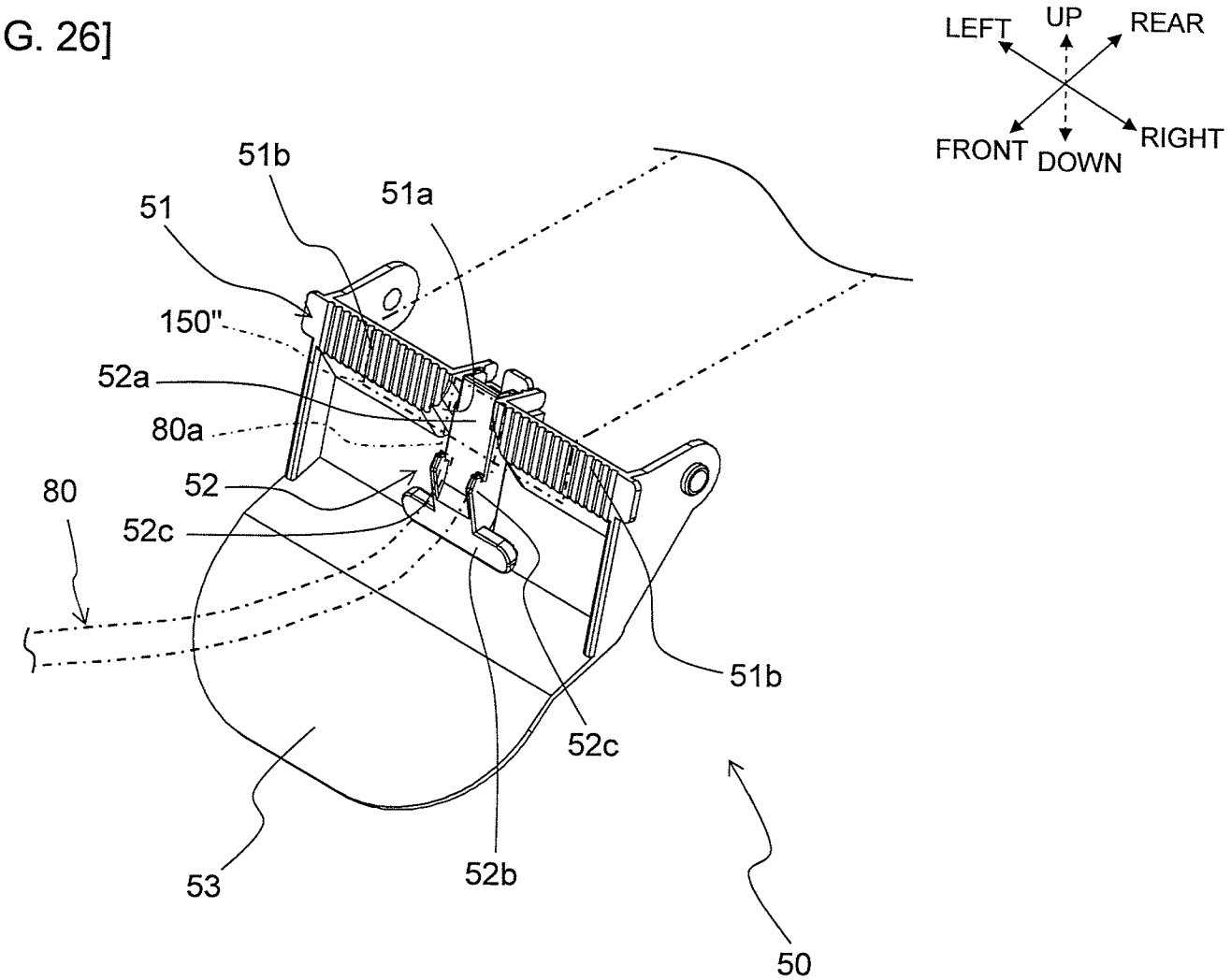

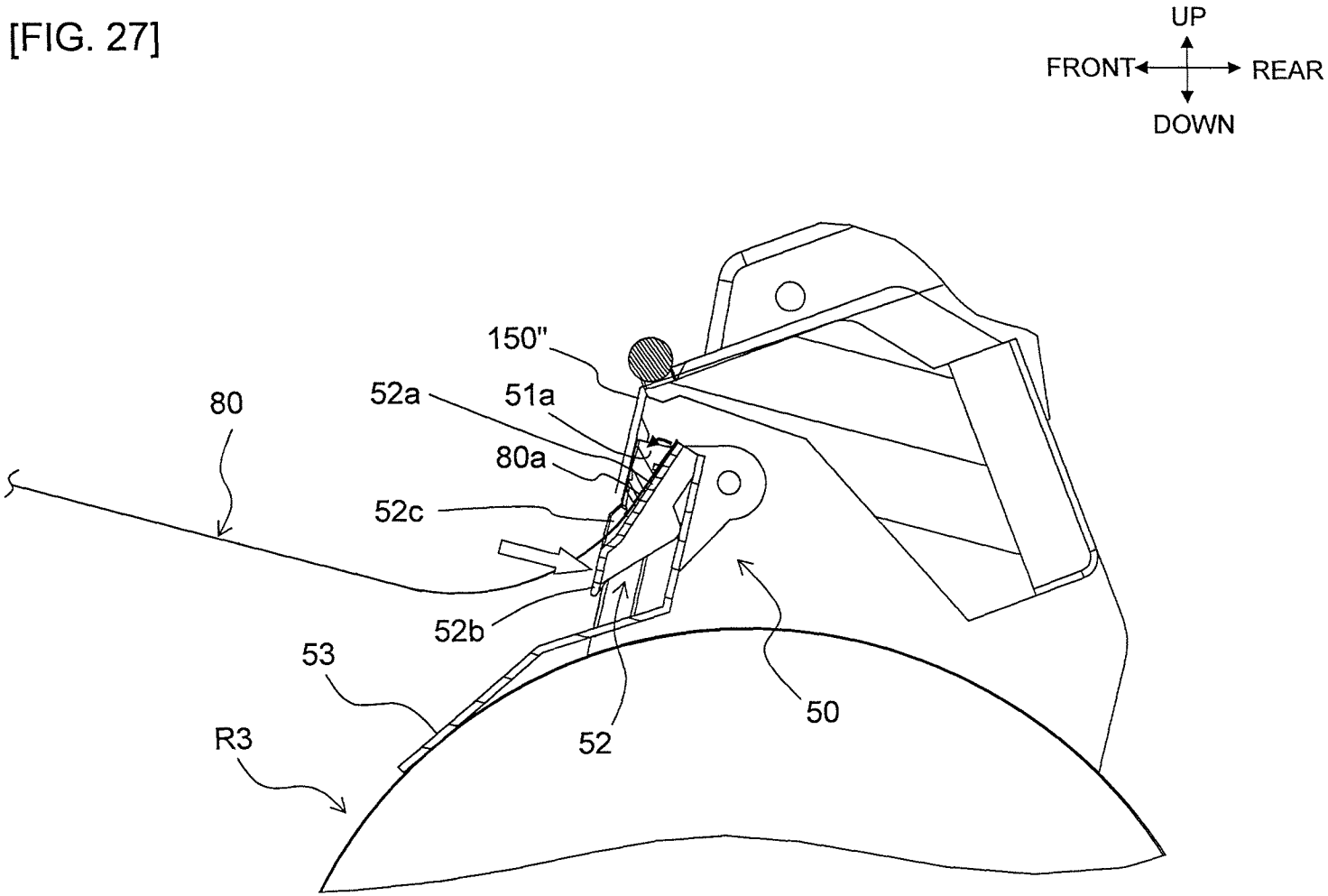
[FIG. 27]

[FIG. 28]
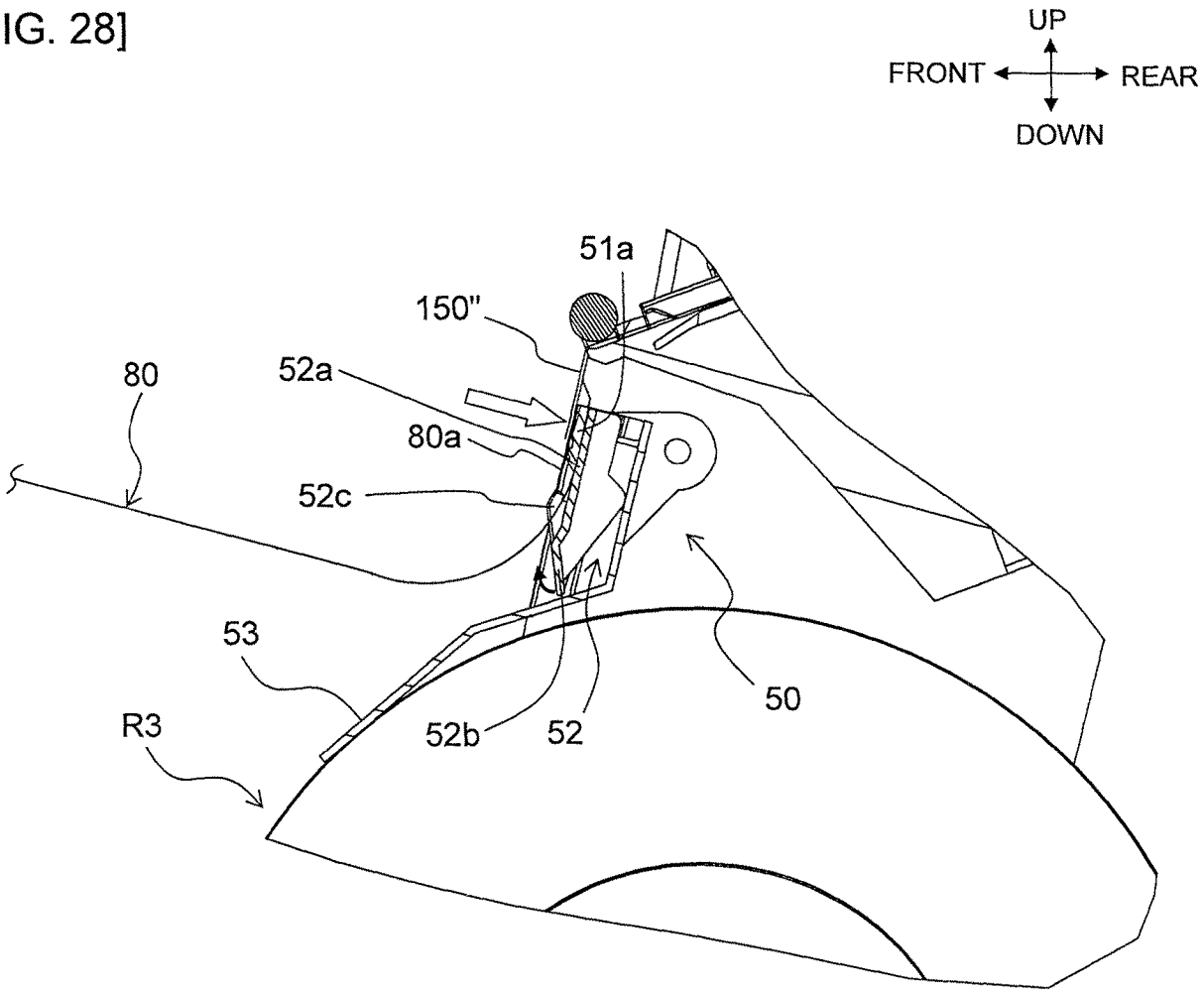

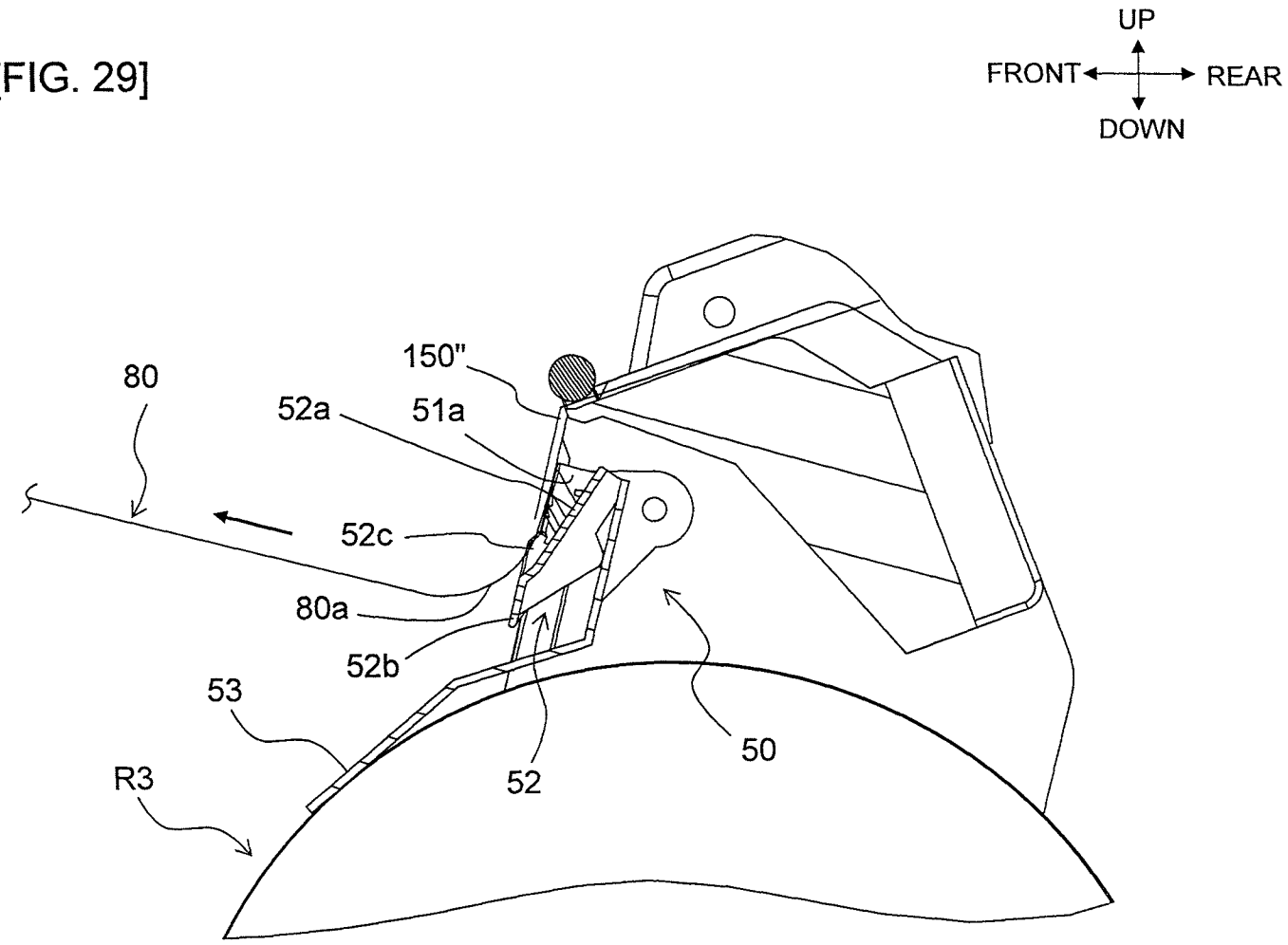
[FIG. 29]

TAPE CARTRIDGE

CROSS-REFERENCE TO RELATED APPLICATION

The present application claims priority from Japanese Patent Application No. 2012-214825, which was filed on Sep. 27, 2012, the disclosure of which is incorporated herein by reference in its entirety.

BACKGROUND

Field

The present disclosure relates to a tape cartridge capable of supplying tape.

Description of the Related Art

Tape printing devices that perform printing while feeding an adhesive tape (tag tape) comprising an adhesive layer and a separation material layer are already known. According to the tape printing device (tag label producing apparatus) of this prior art, the tape cartridge (tag tape roll body) is mounted to and used in a tape holder storage part. An adhesive tape roll, around which the adhesive tape is wound about an axis in the substantially horizontal direction, is rotatably provided at the tape cartridge. Then, when the tape cartridge is mounted to the tape holder storage part, the adhesive tape is fed out and fed by the rotation of the adhesive tape roll. Preferred print is formed on the fed adhesive tape, generating an adhesive tape with print. At the time of use, the separation material layer is peeled from the generated adhesive tape with print by the user. Then, utilizing the adhesive force of the adhesive layer exposed by the peeling of the separation material layer, the adhesive tape with print is affixed to a suitable object to be affixed intended by the user.

From the viewpoint of improving the handling performance by the user, in a case where the separation material layer is to be peeled from the adhesive tape at the time of use as described above, conceivably the peeled separation material layer can also be formed into a roll similar to the adhesive tape, and these two rolls (the adhesive tape roll and the separation material roll) can be incorporated as a single cartridge. In this case, at the time of tape cartridge use, the adhesive tape is consumed by being fed out and fed from the adhesive tape roll. On the other hand, the separation material layer generated by the feeding of the adhesive tape is wound around the separation material roll.

As a result of a mode of use such as described above, according to the tape cartridge, in an unused state (or a state of a short history of usage), a large amount of adhesive tape that has not yet been fed out remains on the adhesive tape roll and the separation material layer is substantially not wound (or not very much wound) around the separation material roll. Accordingly, the adhesive tape roll side is heavier in terms of the weight distribution of the overall cartridge. Then, after the tape cartridge is used for a relatively long period of time, the amount of adhesive tape that has not yet been fed out and remains on the adhesive tape roll decreases, and the amount of separation material layer wound around the separation material roll increases. Accordingly, the separation material roll side is heavier in terms of the weight distribution of the overall cartridge.

That is, the weight balance between the adhesive tape roll side and the separation material roll side changes according to the length of the history of usage of the tape cartridge. As a result, the problem arises that when the tape cartridge is handled and the operator holds a section of the adhesive tape roll side and a section of the separation material roll side using both hands, the left-right balance differs according to the length of the history of usage, making handling difficult.

SUMMARY

It is therefore an object of the present disclosure to provide a tape cartridge that can be favorably and reliably gripped by the operator regardless of the length of the history of usage.

In order to achieve the above-mentioned object, according to the aspect of the present application, there is provided a tape cartridge comprising a first tape roll around which a first tape consumed by feed-out is wound about an axis extending along a first direction, a second tape roll configured to wind a second tape around an axis extending along the first direction and provided on a downstream side of the first tape roll along the second direction, the second tape generated by a feeding of the first tape fed out from the first tape roll along a second direction substantially orthogonal to the first direction, a connecting part that is provided so as to connect the first tape roll and the second tape roll, and configured to rotatably support the first tape roll on one side in the second direction, and rotatably support the second tape roll on the other side in the second direction, and a pair of gripped parts that extends along the second direction in a section of the connecting part on the one side in the second direction, each respectively provided on either side of the connecting part along the first direction, the gripped part comprising a slip preventing part configured to prevent slipping during gripping on an end of the gripped part in the one side along the second direction.

The tape cartridge of the present disclosure comprises a first tape roll and a second tape roll. In the first tape roll, a first tape is wound about an axis in a first direction. At the time of tape cartridge use, the first tape is consumed by being fed out and fed from the first tape roll. On the other hand, the second tape generated by the feeding of the first tape is wound about an axis in the first direction around the second tape roll.

As a result of a mode of use such as described above, according to the tape cartridge of the present disclosure, in an unused state (or a state of a short history of usage), a large amount of the first tape that has not yet been fed out remains on the first tape roll and the second tape is substantially not wound (or not very much wound) around the second tape roll. Accordingly, the first tape roll side is heavier in terms of the weight distribution of the overall cartridge. Then, after the tape cartridge is used for a relatively long period of time, the amount of the first tape that has not yet been fed out and remains on the first tape roll decreases and the amount of the second tape wound around the second tape roll increases. Accordingly, the second tape roll side is heavier in terms of the weight distribution of the overall cartridge.

As described above, in the present disclosure, the weight balance between the first tape roll side and the second tape roll side changes according to the length of the history of usage. As a result, when the tape cartridge is handled and the operator holds a section of the first tape roll side and a section of the second tape roll side using both hands, the left-right balance differs according to the length of the history of usage, making handling difficult.

Hence, according to the present disclosure, a pair of gripped parts is provided, each respectively provided on either side along the first direction of a connecting part that connects the first tape roll and the second tape roll. As a result, with the first tape roll and the second tape roll positioned in the front-rear direction as viewed from the operator, the cartridge can be lifted by gripping the gripped parts from both sides using the left and right hands. Since the cartridge can be handled with the two tape rolls set in the front-rear direction in this manner, regardless of the state of the weight balance between the first tape roll side and the second tape roll side as described above, it is possible to make handling performance less susceptible to the effects of the weight balance. Then, further, according to the present disclosure, a slip preventing part is provided at the other side end along a second direction of the gripped part. With this arrangement, the operator can pinch the slip preventing parts between the fingertips of both hands for support, making it possible to grip the gripped parts in their entirety using the left and right hands while preventing fingertip slipping.

As a result of the above, the tape cartridge of the present disclosure can be favorably and reliably gripped by an operator regardless of the length of the history of usage, thereby improving handling performance.

BRIEF DESCRIPTION OF THE DRAWINGS

FIG. 1 is a right side view showing an outer appearance of the adhesive tape printer of an embodiment.

FIG. 2 is a vertical cross-sectional view showing the internal structure of the adhesive tape printer.

FIG. 3 is a right side view showing the outer appearance of the adhesive tape printer with the second opening/closing cover in an open state.

FIG. 4 is a right side view showing the outer appearance of the adhesive tape printer with the first and the second opening/closing covers in open states.

FIG. 5 is a right side view showing the outer appearance of the adhesive tape printer with the first and the second opening/closing covers as well as the first opening/closing arm in open states.

FIG. 6 is a right side view showing the outer appearance of the adhesive tape printer with the first and the second opening/closing covers as well as the first opening/closing arm and the front-side opening/closing cover in open states.

FIG. 7 is a right side view showing the outer appearance of the adhesive tape printer with the first and the second opening/closing covers as well as the first opening/closing arm, the front-side opening/closing cover, and the second opening/closing arm in open states.

FIG. 8 is an exploded side view showing the adhesive tape printer with the first and second opening/closing covers open and the adhesive tape cartridge and ribbon cartridge removed.

FIG. 9 is a perspective view showing the overall configuration of the adhesive tape cartridge.

FIG. 10 is a right side view showing the overall configuration of the adhesive tape cartridge.

FIG. 11 is an explanatory view showing a mode in which the adhesive tape cartridge is mounted.

FIG. 12 is an explanatory view showing a mode in which the adhesive tape cartridge is mounted.

FIG. 13A is a mirror image of right side view showing the head holder extracted.

FIG. 13B is a left side view showing the head holder extracted.

FIG. 14A is a mirror image of right side view showing the head holder extracted.

FIG. 14B is a left side view showing the head holder extracted.

FIG. 15 is a perspective view for explaining in detail the structure of the support bracket.

FIG. 16 is a perspective view for explaining in detail the structure of the support bracket.

FIG. 17 is a top view for explaining in detail the structure of the support bracket.

FIG. 18 is a perspective view for explaining in detail the structure of the support bracket.

FIG. 19 is a top view for explaining the behavior of the support bracket.

FIG. 20 is a top view for explaining the behavior of the support bracket.

FIG. 21 is a top view for explaining the behavior of the support bracket.

FIG. 22 is a top view for explaining the behavior of the support bracket.

FIG. 23 is a perspective view showing the outer appearance of the core member.

FIG. 24 is an exploded perspective view of the core member.

FIG. 25 is a left side view showing the outer appearance of the core member.

FIG. 26 is a perspective view showing the member that provides the adhesive holding part, switching member, and cover part extracted.

FIG. 27 is an explanatory view for explaining the connecting procedure of the leader tape and adhesive tape with print.

FIG. 28 is an explanatory view for explaining the connecting procedure of the leader tape and adhesive tape with print.

FIG. 29 is an explanatory view for explaining the connecting procedure of the leader tape and adhesive tape with print.

DETAILED DESCRIPTION OF THE PREFERRED EMBODIMENTS

The following describes one embodiment of the present disclosure with reference to accompanying drawings. Note that, in a case where "Front," "Rear," "Left," "Right," "Up," and "Down" are denoted in the drawings, the terms "Front," "Rear," "Left," "Right," "Up (Above)," and "Down (Below)" in the explanations in the description refer to the denoted directions.

General Configuration of Adhesive Tape Printer

First, the general configuration of the adhesive tape printer of this embodiment will be described with reference to FIGS. 1-8.

In FIGS. 1-8, an adhesive tape printer 1 of this embodiment comprises a housing 2 that constitutes the apparatus outer frame, a rear-side opening/closing part 8, and a front-side opening/closing cover 9.

The housing 2 comprises a housing main body 2*a*, a first opening/closing arm 6 that is connected to the upper part of the rear side of the housing main body 2*a* in an openable and closeable manner, and a second opening/closing arm 7 that is connected to the upper part of the front side of the housing main body 2*a* in an openable and closeable manner.

The housing main body 2*a* comprises a first storage part 3 provided at the rear side of the housing main body 2*a*, and a second storage part 4 and a third storage part 5 provided at the front side of the housing main body 2*a*. Note that the first storage part 3, the second storage part 4, and the third storage part 5 will be described in further detail later.

A head holder 10 is provided at the first opening/closing arm 6. The first opening/closing arm 6 is capable of making a print head 11 (described later) of the head holder 10 relatively approach or separate from a platen roller 12

(described later) provided at the housing main body 2*a* by pivoting around a predetermined pivot axis K1 provided at the upper part of the rear side of the housing main body 2*a*. Specifically, the first opening/closing arm 6 is capable of pivoting from a closed position (the states of FIG. 2 and FIG. 4) in which the print head 11 is near the platen roller 12, to an open position (the state of FIG. 8) in which the print head 11 is separated from the platen roller 12.

The second opening/closing arm 7 is capable of opening and closing the area above the second storage part 4 by pivoting around a predetermined pivot axis K2 provided at an upper end of the front side of the housing main body 2*a*. Specifically, the second opening/closing arm 7 is capable of pivoting from a closed position (the states of FIG. 2 and FIG. 6) in which it covers the area above the second storage part 4, to an open position (the state of FIG. 8) in which it exposes the area above the second storage part 4.

The rear-side opening/closing part 8 is connected to the upper part of the rear side of the housing main body 2*a* in an openable and closeable manner. This rear-side opening/closing part 8 is capable of opening and closing the area above the first opening/closing arm 6, that is, the area above the first storage part 3, by pivoting. This rear-side opening/closing part 8 comprises a first opening/closing cover 8*a* and a second opening/closing cover 8*b*.

The first opening/closing cover 8*a* is capable of opening and closing the area above the front side of the first storage part 3 by pivoting around a predetermined pivot axis K3 provided at the upper part of the rear side of the housing main body 2*a*. Specifically, the first opening/closing cover 8*a* is capable of pivoting from a closed position (the states of FIGS. 1-3) in which it covers the area above the front side of the first storage part 3, to an open position (the states of FIGS. 4-7) in which it exposes the area above the front side of the first storage part 3. At this time, the positions of the pivot axis K3 of the first opening/closing cover 8*a* in the front-rear direction and the up-down direction are further on the rear side and further on the upper side, respectively, than a roll center RO of a first roll R1 (described later) stored in the first storage part 3.

The second opening/closing cover 8*b* is provided further on the rear side than the above described first opening/closing cover 8*a*, and is capable of opening and closing the area above the rear side of the first storage part 3 separately from the opening and closing of the above described first opening/closing cover 8*a* by pivoting around a predetermined pivot axis K4 provided at the upper end of the rear side of the housing main body 2*a*. Specifically, the second opening/closing cover 8*b* is capable of pivoting from a closed position (the states of FIG. 1 and FIG. 2) in which it covers the area above the rear side of the first storage part 3, to an open position (the states of FIGS. 3-7) in which it exposes the area above of the rear side of the first storage part 3. At this time, the positions of the pivot axis K4 of the second opening/closing cover 8*b* in the front-rear direction and the up-down direction are further on the rear side and further on the upper side, respectively, than the pivot axis K3 of the above described first opening/closing cover 8*a*. Note that the position of the pivot axis K4 of the second opening/closing cover 8*b* in the up-down direction may be the same as that of the pivot axis K3 of the above described first opening/closing cover 8*a*.

Then, the first opening/closing cover 8*a* and the second opening/closing cover 8*b* are configured so that, when each is in a closed state, an outer peripheral part 18 of the first opening/closing cover 8*a* and an edge part 19 of the second opening/closing cover 8*b* substantially contact each other and cover substantially the entire area above the first storage part 3. Note that the first opening/closing cover 8*a* and the second opening/closing cover 8*b* will be described in further detail later.

The front-side opening/closing cover 9 is connected to the upper part of the front side of the housing main body 2*a* in an openable and closeable manner. This front-side opening/closing cover 9 is capable of opening and closing the area above the second opening/closing arm 7, that is, the area above the second storage part 4, by pivoting around a predetermined pivot axis K5 provided at the upper end of the front side of the housing main body 2*a*. Specifically, the front-side opening/closing cover 9 is capable of pivoting from a closed position (the states of FIGS. 1-5) in which it covers the area above the second storage part 4, to an open position (the states of FIG. 6 and FIG. 7) in which it exposes the area above the second storage part 4.

At this time, an adhesive tape cartridge TK is detachably mounted in a first predetermined position 13 located below the first opening/closing arm 6 in a closed state of the housing main body 2*a*. The adhesive tape cartridge TK comprises the first roll R1, a third roll R3, and a connecting arm 16 that connects the first roll R1 and the third roll R3.

The first roll R1 is rotatably supported on the rear side of the adhesive tape cartridge TK by the connecting arm 16, and a print-receiving adhesive tape 150 consumed by feed-out winds around an axis O1 of the left-right direction. At this time, the first roll R1 is received from above in the first storage part 3 by the mounting of the adhesive tape cartridge TK and stored in a state in which the axis O1 of the winding of the print-receiving adhesive tape 150 is in the left-right direction. Then, the first roll R1, stored in the first storage part 3 (with the adhesive tape cartridge TK mounted), is rotated in a predetermined rotating direction (a direction A in FIG. 2) inside the first storage part 3, thereby feeding out the print-receiving adhesive tape 150. The print-receiving adhesive tape 150 is layered in the order of a base layer 153, an adhesive layer 152, and a separation material layer 151, from one side in the thickness direction (upper side in the partially enlarged view in FIG. 2) to the other side (lower side in the partially enlarged view in FIG. 2). The base layer 153 is a layer on which preferred print is formed by the print head 11 described later. The adhesive layer 152 is a layer for affixing the base layer 153 to a suitable adherent (not shown). The separation material layer 151 is a layer that covers the adhesive layer 152.

Further, the platen roller 12 is provided at a middle upper side of the first storage part 3 and the third storage part 5 of the housing main body 2*a*. The platen roller 12 is driven by a feeding motor M1 provided at the housing main body 2*a* via a gear mechanism (not shown), thereby feeding the print-receiving adhesive tape 150 fed out from the first roll R1 stored in the first storage part 3 in a tape posture in which the tape width direction is in the left-right direction.

Further, the print head 11 is provided at the head holding part 10 provided at the first opening/closing arm 6. The print head 11, as previously described, is capable of relatively approaching or separating from the platen roller 12 by the pivoting of the first opening/closing arm 6 around the pivot axis K1. That is, the print head 11 approaches the platen roller 12 when the first opening/closing arm 6 is in a closed state, and separates from the platen roller 12 when the first opening/closing arm 6 is in an open state. This print head 11 is disposed in a position that faces the area above the platen roller 12 at the first opening/closing arm 6 in a closed state of the head holding part 10, sandwiching the print-receiving adhesive tape 150 fed by the platen roller 12 in coordination with the platen roller 12. Accordingly, when the first opening/closing arm 6 is in a closed state, the print head 11 and the platen roller 12 are disposed facing each other in the up-down direction. Then, the print head 11 forms preferring print on the base layer 153 of the print-receiving adhesive tape 150 sandwiched between the print head 11 and the platen roller 12 using an ink ribbon IB of a ribbon cartridge RK described later, thereby forming an adhesive tape 150' with print. Note that the configuration of the head holding part 10 other than that described above will be described in further detail later.

At this time, the ribbon cartridge RK is detachably mounted in a second predetermined position 14, which is below the first opening/closing arm 6 in a closed state in the housing main body 2*a* and above the adhesive tape cartridge TK. The ribbon cartridge RK comprises a ribbon supply roll R4 and a ribbon take-up roll R5.

The ribbon supply roll R4 is rotatably supported on the rear side of the ribbon cartridge RK, and rotates in a predetermined rotating direction (a direction D in FIG. 2) with the ribbon cartridge RK mounted, thereby feeding out the ink ribbon IB for performing print formation by the print head 11.

The ribbon take-up roll R5 is rotatably supported on the front side of the ribbon cartridge RK and rotates in a predetermined rotating direction (a direction E in FIG. 2) with the ribbon cartridge RK mounted, thereby taking up the used ink ribbon IB after print formation.

Further, a ribbon take-up roller 15 is provided at the downstream side of the print head 11 along the tape feeding direction of the first opening/closing arm 6. The ribbon take-up roller 15 guides the used ink ribbon IB to the ribbon take-up roll R5.

That is, the ink ribbon IB fed out from the ribbon supply roll R4 is disposed further on the print head 11 side of the print-receiving adhesive tape 150 sandwiched between the print head 11 and the platen roller 12, contacting the area below the print head 11. Then, after the ink of the ink ribbon IB is transferred to the base layer 153 of the print-receiving adhesive tape 150 by the heat from the print head 10 to execute print formation, the used ink ribbon IB is taken up on the ribbon take-up roll R5 while guided by the ribbon take-up roller 15.

A connecting arm 16 comprises a peeling part 17 which includes a substantially horizontal slit shape, for example, on the upstream side of the third roll R3 along the tape feeding direction. The peeling part 17 is an area that peels the separation material layer 151 from the adhesive tape 150' with print fed out from the first roll R1 and fed toward the front side. The peeling part 17 peels the separation material layer 151 from the adhesive tape 150' with print, separating the separation material layer 151 and an adhesive tape 150" with print made of the other layers, i.e., the base layer 153 and the adhesive layer 152. Then, the peeled separation material layer 151 is taken up and wound, forming the above described third roll R3. Further, the adhesive tape 150" with print, from which the separation material layer 151 was peeled, is wound around an outer peripheral side of a core member 40, forming a second roll R2 described later. Note that the configuration of the connecting arm 16 other than that described above will be described in further detail later.

The third roll R3 is rotatably supported on the front side of the adhesive tape cartridge TK (that is, the downstream side of the first roll R1 along the tape feeding direction) by the connecting arm 16, and the separation material layer 151 peeled from the adhesive tape 150' with print is wound around an axis O3 of the left-right direction. At this time, the third roll R3 is received from above in the third storage part 5 by the mounting of the adhesive tape cartridge TK and stored in a state in which the axis O3 of the winding of the separation material layer 151 is in the left-right direction. Then, the third roll R3, stored in the third storage part 5 (with the adhesive tape cartridge TK mounted), is driven by a take-up motor M3 provided at the housing main body 2*a* via a gear mechanism (not shown) and rotated in a predetermined rotating direction (a direction C in FIG. 2) inside the third storage part 5, thereby taking up the separation material layer 151.

Further, a support bracket RB connected in an openable and closeable manner to the upper part of the front side of the housing main body 2*a* is provided at the second storage part 4. At this time, the core member 40 for sequentially winding the adhesive tape 150" with print, formed from the peeling of the separation material layer 151 from the adhesive tape 150' with print, is received from above in the second storage part 4 and stored so that it is supported rotatably around the axis O2 by the support bracket RB in a state in which the axis O2 of the winding of the adhesive tape 150" with print is in the left-right direction. Then, the core member 40, stored in the second storage part 4, is driven by the take-up motor M3 provided at the housing main body 2*a* via the gear mechanism and rotated in a predetermined rotating direction (a direction B in FIG. 2) inside the second storage part 4, taking up and layering the adhesive tape 150" with print. With this arrangement, the adhesive tape 150" with print is sequentially wound around the outer peripheral side of the core member 40, forming the second roll R2.

At this time, the support bracket RB is capable of pivoting around a predetermined pivot axis K6 provided at the upper end of the front side of the housing main body 2*a*. Specifically, the support bracket RB is capable of rotating from a closed position (a first position; the states of FIG. 2 and FIG. 6) where it is positioned on the closing direction side of the second opening/closing arm 7 (that is, on the print head 11 side of the first opening/closing arm 6 in a closed state), making the second roll R2 (core member 40) not detachable, to an open position (a second position; the states of FIG. 7 and FIG. 8) where it is positioned on the opening direction side of the second opening/closing arm 7 (that is, the side opposite the print head 11 of the first opening/closing arm 6 in a closed state), making the second roll R2 (the core member 40) detachable.

Note that the above described support bracket RB and the core member 40 will be described in further detail later.

Overview of the Operation of the Adhesive Tape Printer

Next, an overview of the operation of the adhesive tape printer 1 will be described.

That is, when the adhesive tape cartridge TK is mounted in the first predetermined position 13, the first roll R1 is stored in the first storage part 3 positioned on the rear side of the housing main body 2*a*, and the third roll R3 is stored in the third storage part 5 positioned on the front side of the housing main body 2*a*. Further, the core member 40 for forming the second roll R2 is stored in the second storage part 4 positioned on the front side of the housing main body 2*a*.

At this time, when the platen roller 12 is driven, the print-receiving adhesive tape 150 fed out by the rotation of the first roll R1 stored in the first storage part 3 is fed to the front side. Then, preferred print is formed by the print head 11 on the base layer 153 of the fed print-receiving adhesive tape 150, thereby forming the adhesive tape 150' with print. When the adhesive tape 150' with print on which print was formed is further fed to the front side and fed to the peeling part 17, the separation material layer 151 is peeled at the peeling part 17. The peeled separation material layer 151 is fed to the lower side, introduced to the third storage part 5, and wound inside the third storage part 5, forming the third roll R3.

On the other hand, the adhesive tape 150" with print from which the separation material layer 151 was peeled is further fed to the front side, introduced to the second storage part 4, and wound around the outer peripheral side of the core member 40 inside the second storage part 4, thereby forming the second roll R2. At that time, a cutter mechanism provided further on the rear side than the second roll R2, that is, on the upstream side of the second roll R2 along the tape transport direction, cuts the adhesive tape 150" with print on which print was formed and from which the separation material layer 151 was peeled. With this arrangement, the adhesive tape 150" with print wound around the second roll R2 can be cut and the second roll R2 from the second storage part 4 can be removed after cutting based on a timing preferred by the user.

Detailed Structure of Each Part of the Adhesive Tape Printer

Next, the detailed structure of each part of the adhesive tape printer 1 will be sequentially described.

Rear-Side Opening/Closing Part

As previously described, the area above the first storage part 3 in which the first roll R1 is stored can be opened and closed by the rear-side opening/closing part 8. As print formation is executed and the adhesive tape 150" with print is generated as described above, the print-receiving adhesive tape 150 is consumed, decreasing the amount of the print-receiving adhesive tape 150 that is wound around the first roll R1. Accordingly, operator needs include the desire to check the behavior of the first roll R1 inside the first storage part 3 (whether or not the print-receiving adhesive tape 150 has been consumed, decreasing the diameter of the first roll R1, for example) with relatively high frequency. Nevertheless, when the rear-side opening/closing part 8 that opens and closes the area above the first storage part 3 comprises one large opening/closing cover, the large opening/closing cover needs to be opened and closed with high frequency, thereby increasing the operation burden of the operator.

Here, according to this embodiment, the rear-side opening/closing part 8 that opens and closes the area above the first storage part 3 comprises two opening/closing covers (the first opening/closing cover 8*a* and the second opening/closing cover 8*b*) as previously described. That is, the area above the front side of the first storage part 3 can be opened and closed by the first opening/closing cover 8*a*, and the area above the rear side of the first storage part 3 can be opened and closed by the second opening/closing cover 8*b*.

At this time, a apply force member (not shown; an extension coil spring, for example) is provided at the upper end of the rear side of the housing main body 2*a*. This apply force member causes a applying force energized toward the closing direction of the second opening/closing cover 8*b* to act on the second opening/closing cover 8*b*. Then, when the first opening/closing cover 8*a* moves in the opening direction, the edge part 19 of the second opening/closing cover 8*b* substantially in contact with the outer peripheral part 18 of the first opening/closing cover 8*a* slides as it receives the driving force caused by the contact from the outer peripheral part 18. With this arrangement, the second opening/closing cover 8*b* resists the applying force of the above described apply force member due to the driving force received by the edge part 19 and thus also moves in the opening direction in tandem with the movement of the above described first opening/closing cover 8*a* in the opening direction.

Accordingly, when the operator wants to check the behavior of the first roll R1 inside the first storage part 3, the operator may manually operate only the second opening/closing cover 8*b* in the opening direction while leaving the first opening/closing cover 8*a* in a closed state. When the operator performs this operation, only the second opening/closing cover 8*b* moves in the opening direction and opens, opening only the area above the rear side of the first storage part 3 (the state of FIG. 3).

On the other hand, when the operator wants to largely open the area above the first storage part 3 and store (or remove) the first roll R1, the operator may manually operate only the first opening/closing cover 8*a* in the opening direction. When the operator performs this operation and the first opening/closing cover 8*a* moves in the opening direction, the edge part 19 of the second opening/closing cover 8*b* slides as it receives the driving force caused by the contact from the outer peripheral part 18 of the first opening/closing cover 8*a*, and, resisting the applying force of the above described apply force member due to the received driving force, the second opening/closing cover 8*b* automatically moves in the opening direction as well in tandem with the movement of the first opening/closing cover 8*a* in the opening direction. With this arrangement, both the first opening/closing cover 8*a* and the second opening/closing cover 8*b* open, largely opening the overall area above the first storage part 3 (the state of FIGS. 4-7).

Note that, after storage (or removal) of the first roll R1, the operator manually operates the first opening/closing cover 8*a* in the closing direction, causing the second opening/closing cover 8*b* to automatically move in the closing direction as well in tandem with the movement of the first opening/closing cover 8*a* in the closing direction due to the applying force of the above described apply force member. With this arrangement, both the first opening/closing cover 8*a* and the second opening/closing cover 8*b* become closed, closing substantially the entire area above the first storage part 4 (the state of FIG. 1).

Adhesive Tape Cartridge

In FIGS. 8-10, the adhesive tape cartridge TK, as previously described, comprises the first roll R1, the third roll R3, and the connecting arm 16. The connecting arm 16 comprises a left and right pair of first bracket parts 20 and 20 provided at the rear side, and a left and right pair of second bracket parts 21 and 21 provided at the front side. Note that, in FIG. 9, the print-receiving adhesive tape 150 wound around the axis O1 on the first roll R1, and the separation material layer 151 wound around the axis O3 on the third roll R3 are not shown, and the member comprising the first roll R1 and the third roll R3 is partially not shown.

The first bracket parts 20 and 20 sandwich the first roll R1 between both left and right sides (one side and the other side) along the axis O1, rotatably holding it around the axis O1. These first bracket parts 20 and 20 are connected by a first connecting part 22 that extends substantially along the left-right direction on the upper end, preventing interference with the outer diameter of the first roll R1.

The second bracket parts 21 and 21 sandwich the third roll R3 between both left and right sides (one side and the other side) along the axis O3, rotatably holding it around the axis O3. These second bracket parts 21 and 21 are connected by a second connecting part 23 that extends substantially along the left-right direction on the upper end.

Then, the first bracket parts 20 and 20 and the first connecting part 22 on the rear side, and the second bracket parts 21 and 21 and the second connecting part 23 on the front side are connected by a left and right pair of roll connecting beam parts 24 and 24.

Here, as previously described, when the adhesive tape cartridge TK is used, the print-receiving adhesive tape 150 is fed out from the first roll R1 and fed, thereby consuming the print-receiving adhesive tape 150. On the other hand, the separation material layer 151, which was peeled by the above described peeling part 17 from the adhesive tape 150' with print on which print was formed after the feeding of the print-receiving adhesive tape 150, is wound around the axis O3 on the third roll R3.

As a result of such an above described mode of use, as shown in FIG. 11, when the adhesive tape cartridge TK is not used (or when the history of usage is short), a large amount of the print-receiving adhesive tape 150 not yet fed out remains on the first roll R1 and the separation material layer 151 is substantially not wound (or not very much wound) around the third roll R3. Accordingly, in this state, the first roll R1 side becomes heavier in terms of the weight distribution of the entire adhesive tape cartridge TK, and a center of gravity CG of the adhesive tape cartridge TK is positioned on the first roll R1 side. Then, as shown in FIG. 12, after the adhesive tape cartridge TK is used for a relatively long period of time (when the history of usage of the adhesive tape cartridge TK is long), the amount of the print-receiving adhesive tape 150 that has not yet been fed out and remains on the first roll R1 decreases, and the amount of the separation material layer 151 wound around the third roll R3 increases. Accordingly, in this state, the third roll R3 side becomes heavier in terms of the weight distribution of the entire adhesive tape cartridge TK, and the center of gravity CG of the adhesive tape cartridge TK is positioned on the third roll R3 side.

As described above, in this embodiment, the weight balance between the first roll R1 side and the third roll R3 side changes according to the length of history of usage of the adhesive tape cartridge TK. As a result, when the adhesive tape cartridge TK is handled and the operator holds a section of the first roll R1 side and a section of the third roll R3 side using both hands, the above described weight balance differs according to the length of the history of usage of the adhesive tape cartridge TK, making handling difficult.

Here, according to this embodiment, a left and right pair of handle parts 25 and 25 extends along the front-rear direction on the rear side (first roll R1 side) of the connecting arm 16 that connects the first roll R1 and the third roll R3, each provided at the respective left or right side, as shown in FIGS. 8-10. Specifically, the handle parts 25 and 25 are provided so that they respectively protrude outward along the right-left direction from the first bracket parts 20 and 20 positioned on both left and right sides of rear side of the connecting arm 16. Accordingly, when the adhesive tape cartridge TK is to be lifted, the operator may grip the handle parts 25 and 25 that respectively protrude in the left-right direction from the first bracket parts 20 and 20 using the left hand and the right hand, respectively, with the first roll R1 and the third roll R3 positioned in the front-rear direction.

Then, further, according to this embodiment, slip preventing parts 25*a* and 25*a* that prevent slipping at the time of gripping are provided at the ends of the rear side of handle parts 25 and 25. Accordingly, when gripping the handle parts 25 and 25, the operator may support the gripping by pinching the slip preventing parts 25*a* and 25*a* between the fingertips of the left hand and right hand, respectively.

At this time, the slip preventing parts 25*a* and 25*a* are disposed so that the position in the radial direction of the first roll R1 is further on the radial inside than the first connecting part 22 that is provided at prevent interference with the outer diameter of the first roll R1, and are configured so that the dimension along the radial direction of the first roll R1 is greater than the dimensions of the other areas of the handle parts 25 and 25.

Here, due to the difference in weight balance of the entire adhesive tape cartridge TK based on the length of the history of usage thereof, various angles of inclination of the adhesive tape cartridge TK occur when the operator grips the handle parts 25 and 25 and lifts the adhesive tape cartridge TK. For example, the angle of inclination of the adhesive tape cartridge TK is relatively gentle in the example shown in FIG. 11 which corresponds to a time of non-use (or a short history of usage) of the adhesive tape cartridge TK, and conversely quite sharp in the example shown in FIG. 12 which corresponds to a time after the adhesive tape cartridge TK was used for a relatively long period of time (a long history of usage of the adhesive tape cartridge TK). Here, according to this embodiment, the slip preventing parts 25*a* and 25*a* are substantially partially arcuate in shape when viewed in the left-right direction.

Head Holder

In FIGS. 8, 9, 13 and 14, the head holder 10 provided at the first opening/closing arm 6 comprises the above described print head 11, the above described ribbon take-up roller 15, and a pivoting member 27. Note that, in FIG. 9, the head holder 10 provided at the first opening/closing arm 6 and the platen roller 12 provided at the housing main body 2*a* are shown along with the adhesive tape cartridge TK as well. Further, FIG. 13 corresponds to a case where the first opening/closing arm 6 is in an open state, and FIG. 14 corresponds to a case where the first opening/closing arm 6 is in a closed state. Further, FIG. 13A and FIG. 14A show the right lateral side of the head holder 10, and FIG. 13B and FIG. 14B show the left lateral side of the head holder 10.

The print head 11, as previously described, is capable of relatively approaching or separating from the above described platen roller 12 by the pivoting of the first opening/closing arm 6 around the above described pivot axis K1. That is, the print head 11 approaches the platen roller 12 when the first opening/closing arm 6 is in a closed state, and separates from the platen roller 12 when the first opening/closing arm 6 is in an open state.

The pivoting member 27 is capable of pivoting around a predetermined pivot axis K7 (axis) provided near the print head 11, and comprises a head cover part 27*b* provided near the print head 11, and a left and right pair of side plate parts 27*a* and 27*a* that are substantially shaped like the numeral 3, each provided at the respective left or right side of the head cover part 27*b*.

The head cover part 27*b* is configured so that it protects the platen roller 12 side of the print head 11 when the print head 11 is separated from and exposes the platen roller 12, and recesses from and exposes the platen roller 12 side of the print head 11 when the above described print formation is executed. Specifically, the head cover part 27*b* is capable of switching between a covering position (a first position; the states of FIG. 13A and FIG. 13B) in which it covers the platen roller 12 side of the print head 11, and an exposing position (a second position; the states of FIG. 14A and FIG. 14B) in which it exposes the platen roller 12 side of the print head 11, by the pivoting of the entire pivoting member 27 around the pivot axis K7.

At this time, an extension coil spring 29 is provided at the left lateral side of the head holder 10. The extension coil spring 29 causes a applying force energized in the direction of an arrow Z to act on the side plate part 27*a* on the left side.

The side plate parts 27*a* and 27*a* are capable of pivoting around the pivot axis K7. Further, edge parts 271 and 271 of the side plate parts 27*a* and 27*a* are capable of receiving a force from a shaft part 12*a* of the platen roller 12 that is produced due to the relative approaching movement of the platen roller 12 and the print head 11 in tandem with the opening/closing movement of the first opening/closing arm 6 (specifically, produced due to the mutual approach between the platen roller 12 and the print head 11 based on the closing movement of the first opening/closing arm 6). That is, when the first opening/closing arm 6 is in a closed state, the edge parts 271 and 271 of the side plate parts 27*a* and 27*a* are pressed to the upper side by the shaft part 12*a* of the platen roller 12 from the upper side.

Then, in accordance with whether or not a force from the shaft part 12*a* of the platen roller 12 is received by the edge parts 271 and 271 of the side plate parts 27*a* and 27*a*, the entire pivoting member 27 is selectively pivoted to either a state in which the head cover part 27*b* is in a covering position or a state in which the head cover part 27*b* is in an exposing position.

That is, as shown in FIG. 13, when the first opening/closing arm 6 is in an open state and the edge parts 271 and 271 of the side plate parts 27*a* and 27*a* do not receive a force from the shaft part 12*a* of the platen roller 12, the applying force of the extension coil spring 29 causes the entire pivoting member 27 to be in a state in which the head cover part 27*b* is in the covering position.

Then, as shown in FIG. 14, when the first opening/closing arm 6 is in a closed state, the edge parts 271 and 271 of the side plate parts 27*a* and 27*a* receive a force from the shaft part 12*a* of the platen roller 12 and resist the applying force of the extension coil spring 29, causing the entire pivoting member 27 to pivot to a state in which the head cover part 27*b* is in the exposing position. Note that, when pivoted to the expositing position as described above, the head cover part 27*b* is inserted and disposed so as to enter a space that is produced between the print head 11 and the above described ribbon take-up roller 15.

Subsequently, as shown in FIG. 13, when the first opening/closing arm 6 is changed to an open state once again, the edge parts 271 and 271 of the side plate parts 27*a* and 27*a* do not receive a force from the shaft part 12*a* of the platen roller 12, causing the applying force of the extension coil spring 29 to pivot the entire pivoting member 27 to a state in which the head cover part 27*b* is in the covering position.

Further, at this time, a limit switch SW for detecting the opening and closing of the first opening/closing arm 6 is provided at the right lateral side of the head holder 10. The limit switch SW comprises a rotating lever 28 capable of switching between a first position (the state of FIG. 13A) that detects that the first opening/closing arm 6 is in an open state, and a second position (the state of FIG. 14A) that detects that the first opening/closing arm 6 is in a closed state.

That is, when the first opening/closing arm 6 is in a closed state, the rotating lever 28 is positioned in the second position, as shown in FIG. 14. In this case, the limit switch SW detects that the first opening/closing arm 6 is in a closed state. Then, when the first opening/closing arm 6 changes to an open state, the rotating lever 28 is pressed to the upper side by the side plate part 27*a* on the right side, rotating to the first position, as shown in FIG. 13. In this case, the limit switch SW detects that the first opening/closing arm 6 is in an open state.

Support Bracket

In FIG. 8 and FIGS. 15-22, the support bracket RB, as previously described, pivotably supports the second roll R2, around which is wound the adhesive tape 150" with print, about the axis O2 on the core member 40. Note that, in FIGS. 15-18, the second roll R2 is not shown. Further, the support bracket RB is capable of pivoting from a closed position where the second roll R2 is not detachable, to an open position where the second roll R2 is detachable. Then, when the support bracket RB is positioned in the closed position, the second roll R2 (the core member 40) rotates, executing the above described print formation and winding the adhesive tape 150" with print around the core member 40.

At this time, the support bracket RB comprises a first bracket RB1 and a second bracket RB2. The first bracket RB1 and the second bracket RB2 are respectively disposed facing both left and right sides along the axis O2 direction, which is the axial direction of the second roll R2, sandwiching the second roll R2, and are capable of approaching or separating from each other along the left-right direction. In this example, only the second bracket RB2 is movable in the left-right direction, and the left-right direction position of the first bracket RB1 is fixed. Further, a reinforcing plate 38 capable of connecting the lower areas of the first bracket RB1 and the second bracket RB2 is provided at the support bracket RB.

The first bracket RB1 comprises a substantially circular-shaped circular part 31*a* and a base part 32*a* that bulges in the radial direction from the circular part 31*a*, and the second bracket RB2 comprises a substantially circular-shaped circular part 31*b* and a base part 32*b* that bulges in the radial direction from the circular part 31*b*.

A compression spring 34 is provided at the inside of the base part 32*a* of the first bracket RB1 (to the side facing the base part 32*b* of the second bracket RB2). The compression spring 34 causes a applying force energized in the direction in which the first bracket RB1 and the second bracket RB2 separate from each other (in this example, in the direction in which the second bracket RB2 separates from the first bracket RB1) to act on a spring bracket 33 provided at the inside of the base part 32*b* of the second bracket RB2 (the side facing the base part 32*a* of the first bracket RB1).

An inclined cam part 35 is provided at the outside of the circular part 31*b* of the second bracket RB2 (the side opposite the side facing the base part 32*a* of the first bracket RB1). Due to the pivoting of the support bracket RB (the first bracket RB1 and the second bracket RB2) from the open position toward the closed position, the inclined cam part 35 resists the applying force of the compression spring 34 and receives a force that makes the first bracket RB1 and the second bracket RB2 approach each other (in this example, a force that makes the second bracket RB2 approach the first bracket RB1) from a wall part 36 of the housing main body 2*a*. That is, due to the pivoting of the support bracket RB from the open position to the closed position, the inclined cam part 35 is pressed to the left side by the wall part 36 of the housing main body 2*a*.

With the above described configuration, when the operator pivots the support bracket RB from the closed position to the open position, the applying force of the compression spring 34 causes the first bracket RB1 and the second bracket RB2 to relatively move in directions of separation from each other (in this example, the second bracket RB2 moves in a direction of separation from the first bracket RB1) as the support bracket RB pivots from the closed position toward the open position (as the mode of the support bracket RB transitions to those of FIG. 19, FIG. 20, FIG. 21, and FIG. 22). With this arrangement, with the support bracket RB positioned in an open position (the states of FIG. 8, FIGS. 15-17, and FIG. 22), the second roll R2 (the core member 40) becomes detachable from the space between the first bracket RB1 and the second bracket RB2 separated as described above.

On the other hand, when the second roll R2 (the core member 40) is newly mounted, for example, and the operator pivots the support bracket RB from an open position to a closed position after disposing the second roll R2 (the core member 40) between the first bracket RB1 and the second bracket RB2 separated as described above, a force such as one that resists the applying force of the compression spring 34 acts on the second bracket RB2 due to the force received by the inclined cam part 35 from the wall part 36 of the housing main body 2*a* as the support bracket RB pivots from the open position toward the closed position (as the mode of the support bracket RB transitions to those of FIG. 22, FIG. 21, FIG. 20, and FIG. 19), thereby relatively moving the first bracket RB1 and the second bracket RB2 in directions of approaching each other (in this example, moving the second bracket RB2 in a direction of approaching the first bracket RB1). With this arrangement, in the state in which the support bracket RB is positioned in a closed position (the state of FIG. 19), the second roll R2 (the core member 40) is mounted in a non-detachable state.

Further, in the state in which the support bracket RB is positioned in a closed position (the state of FIG. 19), a driven gear 37*b* (refer to FIG. 15) provided at the first bracket RB1 engages with a drive transmitting gear 37*a* provided at the front side and the left side of the housing main body 2*a*. Further, the drive transmitting gear 37*a* is connected in operation to an output shaft (not shown) of the aforementioned take-up motor M3 via a gear mechanism provided at the front side of the housing main body 2*a*. As a result, the driving force produced by the take-up motor M3 is transmitted to the first bracket RB1 via the gear mechanism, the drive transmitting gear 37*a*, and the driven gear 37*b* provided at the front side of the housing main body 2*a*, in a state in which the support bracket RB is positioned in the above described closed position. Then, the above described driving force transmitted to the first bracket RB1 is transmitted to the second roll R2 (the core member 40) mounted between the first bracket RB1 and the second bracket RB2, thereby rotationally driving the second roll R2 (the core member 40).

Further, when the support bracket RB (the first bracket RB1 and the second bracket RB2) pivots from a closed position and arrives at an open position (in the states of FIG. 8, FIGS. 15-17, and FIG. 22), a concave part 39*b* provided at the edge of the circular part 31*b* of the second bracket RB2 engages with a protrusion 39*a* provided at the front side and the right side of the housing main body 2*a*, and the above described reinforcing plate 38 butts against the surface on the inside of the second opening/closing arm 7 (refer to FIG. 8), thereby preventing the support bracket RB from pivoting any further.

Core Member

In FIGS. 23-25, the core member 40 comprises a substantially cylindrical inner cylinder 41, a first outer cylinder 42, and a second outer cylinder 43, with the above described axis O2 serving as the axis.

The first outer cylinder 42 is mounted to the outer peripheral side of one side end (specifically, the right end) of the inner cylinder 41 along the axial direction (that is, in the left-right direction, which is the direction of the axis O2). This first outer cylinder 42 comprises a substantially cylindrical first cylinder part 45, and a substantially circular first flange part 46 integrally formed on the right end of the first cylinder part 45.

The second outer cylinder 43 is mounted to the outer peripheral side of the other side end (specifically, the left end) of the inner cylinder 41 along the axial direction (that is, in the left-right direction, which is the direction of the axis O3). This second outer cylinder 43 comprises a substantially cylindrical second cylinder part 47, and a substantially circular second flange part 48 integrally formed on the left end of the second cylinder part 47.

That is, with the first outer cylinder 42 and the second outer cylinder 43 mounted to the inner cylinder 41, the first flange part 46 and the second flange part 48 are disposed facing each other, forming a space between the first flange part 46 and the second flange part 48 capable of receiving the above described adhesive tape 150" with print.

Further, with the first outer cylinder 42 and the second outer cylinder 43 mounted to the inner cylinder 41, the first cylinder part 45 and the second cylinder part 47 extend substantially along the axis O2 so as to connect the first flange part 46 and the second flange part 48, and a substantially cylindrical paper core 44 (winding cylinder) is mountable to the outer peripheral side of the first cylinder part 45 and the second cylinder part 47 (in other words, in the space between the first flange part 46 and the second flange part 48). The paper core 44 is a member for winding the adhesive tape 150" with print formed by the peeling of the separation material layer 151 from the adhesive tape 150' with print at the aforementioned peeling part 17 around the outer peripheral side so that the tape width direction is in the left-right direction. Note that FIG. 23 shows a state in which the paper core 44 is not mounted to the outer peripheral side of the first cylinder part 45 and the second cylinder part 47, and FIG. 24 shows a state in which the adhesive tape 150" with print is not wound around the outer peripheral side of the paper core 44.

An example of the procedure for fabricating the core member 40 will now be described. That is, when the core member 40 is fabricated, first the second cylinder part 47 of the second outer cylinder 43 is inserted on the outer peripheral side of the left end of the inner cylinder 41. At this point in time, the paper core 44 is not yet mounted to the outer peripheral side of the second cylinder part 47, and the second outer cylinder 43 that includes the second flange part 48 is movable in the left-right direction. Then, the second outer cylinder 43 is moved in the left-right direction so that it corresponds to the width direction dimension of the paper core 44, and the paper core 44 is mounted to the outer peripheral side of the second cylinder part 47 while the left end is positioned by the second flange part 48 so that the left end contacts a right end surface 48*a* of the second flange part 48 of the second outer cylinder 43. When the paper core 44 is mounted to the outer peripheral side of the second cylinder part 47, the second outer cylinder 43 that includes the second flange part 48 becomes fixed to the outer peripheral side of the inner cylinder 41 and is no longer movable in the left-right direction. Then, the first outer cylinder 42 that includes the first flange part 46 is removably installed to the outer periphery of the right end of the inner cylinder 41 where the paper core 44 exists on the outer peripheral side. At this time, the right end of the paper core 44 is positioned by the first flange part 46 so that the right end contacts a left end surface 46*a* of the first flange part 46 of the first outer cylinder 42. Thus, the core member 40 is fabricated.

Then, when the core member 40 is stored in the aforementioned second storage part 4 in a state where it is mounted in a manner supported by the above described support bracket RB, take-up of the above described adhesive tape 150" with print is performed. That is, the entire core member 40 rotates around the axis O2 while the adhesive tape 150" with print is sequentially wound around the outer peripheral side of the paper core 44. With this arrangement, the adhesive tape 150" with print is sequentially wound around and layered on the outer peripheral side of the paper core 44, forming the second roll R2. At this time, to streamline the start of the winding movement such as described above, a leader tape 80 is provided at the paper core 44 (refer to FIG. 24). A substantially snake-head shaped leading edge part 80*a* of the leader tape 80 is extended toward the outside of the paper core 44. The adhesive layer 152 provided at the adhesive tape 150" with print sticks and is connected to this leading edge part 80*a* (refer to FIG. 9). With this arrangement, the entire core member 40 that includes the paper core 44 rotates around the axis O2, thereby causing the adhesive tape 150" with print connected to the leading edge part 80*a* of the leader tape 80 to be pulled to the paper core 44 side and sequentially wind around and become layered on the outer periphery of the paper core 44, forming the second roll R2.

Further, at this time, the second flange part 48 of the above described two flange parts (the first flange part 46 and the second flange part 48), is a structure fixed to the inner cylinder 41, and the first flange part 46 is removable from the inner cylinder 41. With this arrangement, when the adhesive tape 150" with print is sequentially introduced into the space between the above described first flange part 46 and the second flange part 48 and layered on the paper core 44 installed to the first cylinder part 45 and the second cylinder part 47 to form the second roll R2 with the rotation of the core member 40, the first outer cylinder 42 that includes the first flange part 46 is removed from the inner cylinder 41. Then, the second roll R2 is extracted along the left-right direction from the side of the inner cylinder 41 from which the first outer cylinder 42 was removed.

Here, since the adhesive tape 150" with print comprises the adhesive layer 152 as previously described, adhesive may appear on the roll side surface of the second roll R2 with the adhesive tape 150" with print layered as described above. In this case, the second roll R2 may become affixed to the second flange part 48 by the adhesive, causing difficulties in the aforementioned extraction in the left-right direction.

Here, according to this embodiment, openings 480 and 480 are provided in two locations facing each other in the radial direction, each on either side of the axis O2 of the substantially circular shape of the second flange part 48. Note that the openings 480 may be provided in three or more locations including the two locations of the substantially circular shape of the second flange part 48. At this time, each of the openings 480 and 480 comprises a radial dimension from a predetermined first radial position P1 to a second radial position P2 further on the inner peripheral side, and a predetermined circumferential dimension. The second radial position P2 is set so that it is further on the inner peripheral side than an outer diameter position P3 of the paper core 44 mounted to the first cylinder part 45 and the second cylinder part 47; more specifically, so that the position P2 substantially matches the radial inside end of the second flange part 48. With this arrangement, as shown in FIG. 25, when the second roll R2 is formed as described above, at least a part of the paper core 44 (the inclined section in FIG. 25) is exposed in the left-right direction via the openings 480 and 480 of the above described second flange part 48.

Further, at this time, each of the openings 480 and 480 is substantially trapezoidal in shape, with the length of the edge part 480*a* on the radial inside longer than the length of the edge part 480*b* on the radial outside. Note that each of the openings 480 and 480 may be substantially triangular in shape with the length of the edge part of the radial inside longer than the length of the edge part of the radial outside.

Adhesive Holding Part

In FIG. 9 and FIG. 26, as previously described, when the adhesive tape cartridge TK is mounted to the housing main body 2*a*, the print-receiving adhesive tape 150 is fed out by the rotation of the first roll R1 stored in the first storage part 3 and fed to the front side. Then, preferred print is formed by the print head 11 on the base layer 153 of the fed print-receiving adhesive tape 150, thereby forming the adhesive tape 150' with print. The adhesive tape 150' with print on which print was formed is further fed toward the front side, and the separation material layer 151 is peeled at the peeling part 17. The peeled separation material layer 151 is fed to the lower side, introduced to the third storage part 5, and taken up and wound inside the third storage part 5, forming the third roll R3. Further, the adhesive tape 150" with print from which the separation material layer 151 was peeled is further fed to the front side, introduced to the second storage part 4, and wound around the outer peripheral side of the core member 40 inside the second storage part 4, thereby forming the second roll R2.

Then, when the adhesive tape 150" with print is cut by the aforementioned cutter mechanism, the adhesive tape cartridge TK is sometimes removed from the housing main body 2*a* and moved, etc., by the operator. At this time, since the adhesive tape 150" with print is formed by the peeling of the separation material layer 151 from the adhesive tape 150' with print, the adhesive layer 152 is exposed. In this embodiment, a member 50 is provided near the peeling part 17 positioned on the front side of the adhesive tape cartridge TK. Note that the member 50 is shown only in FIG. 9 and FIGS. 26-29, and is omitted in other figures.

An adhesive holding part 51 is provided at the member 50 in preparation for cases in which the adhesive layer 152 exposed on the above described adhesive tape 150" with print is to be temporarily tacked (reseparably adhered) when the adhesive tape cartridge TK is handled as a single unit prior to mounting to the housing main body 2*a* and for cases in which the adhesive tape cartridge TK is mounted to the housing main body 2*a* to start generation of the second roll R2. The adhesive holding part 51 comprises a concave part 51*a* and adhesive receiving parts 51*b* and 51*b* respectively provided at both left and right sides of the concave part 51*a*.

The concave part 51*a* comprises a width direction dimension that is smaller than the width of the adhesive tape 150" with print and larger than the width of the leading edge part 80*a* of the above described leader tape 80. This concave part 51*a* holds the center area positioned in the width direction substantial center of the adhesive layer 152 exposed on the adhesive tape 150" with print that is adhered across the adhesive receiving parts 51*b* and 51*b* positioned on both left and right sides of the concave part 51*a* as described later, in a state where it is exposed in the air. At this time, the concave part 51*a* is configured so that it is capable of receiving the leading edge part 80*a* of the leader tape 80 extended from the above described paper core 44 toward the outside.

The adhesive receiving parts 51*b* and 51*b* are subjected to release processing by formation of a serration-shaped protrusion on the front surface. These adhesive receiving parts

51*b* and 51*b* reseparably adhere and hold both side areas of the adhesive layer 152 exposed on the adhesive tape 150" with print that are positioned on both width direction sides of the above described center area, with the adhesive layer 152 separated from the leading edge part 80*a* of the leader tape 80 received by the above described concave part 51*a* in the tape thickness direction.

Further, a substantially T-shaped switching member 52 is installed to the member 50. A sticking part 52*a* is provided at the switching member 52 so that it is positioned on the concave part 51*a*. On the sticking part 52*a*, the leading edge part 80*a* of the leader tape 80 is hooked by and stuck to convex parts 52*c* and 52*c* provided at the left and right ends of the switching member 52. Further, the switching member 52 is capable of pivoting around a predetermined pivot axis provided at the member 50. Specifically, the switching member 52 is capable of pivoting (switching and moving) between a separated position (the states of FIG. 27 and FIG. 29) and a close contact position (the state of FIG. 28).

The separated position is a position in which the sticking part 52*a* is moved to the above described center area side of the adhesive tape 150" with print held in an exposed state by the concave part 51*a*. In this separated position, it is possible to separate the leading edge part 80*a* of the leader tape 80 stuck to the sticking part 52*a* and the center area of the above described adhesive tape 150" with print in the tape thickness direction.

The close contact position is a position in which the sticking part 52*a* is moved to the side opposite the above described center area side of the adhesive tape 150" with print held in an exposed state by the concave part 51*a*. In this close contact position, it is possible to make the leading edge part 80*a* of the leader tape 80 stuck to the sticking part 52*a* and the center area of the above described adhesive tape 150" with print approach and come in close contact with each other in the tape thickness direction.

Further, a cover part 53 that hangs down in the shape of an eave is provided at the member 50 to cover the area of the second roll R2 that is on the side of the adhesive tape 150" with print from which the separation material layer 151 was peeled at the peeling part 17.

Accordingly, in a case where the adhesive layer 152 exposed on the adhesive tape 150" with print is to be temporarily tacked, the operator may adhere the above described both side areas of the adhesive tape 150" with print to the adhesive receiving parts 51*b* and 51*b*. Then, in a case where generation of the second roll R2 is to be started, the operator may connect the leader tape 80 and the above described temporarily tacked adhesive tape 150" with print.

An example of the procedure for connecting the leader tape 80 and the above described temporarily tacked adhesive tape 150" with print will be described with reference to FIGS. 27-29. That is, first, as shown in FIG. 27, the operator hooks the leading edge part 80*a* of the leader tape 80 to the convex parts 52*c* and 52*c* of the switching member 52 set to the separated position in advance, sticking the leading edge part 80*a* to the sticking part 52*a*, and then switches the switching member 52 to the close contact position (the state of FIG. 28) by pressing a substantially flat plate shaped flat plate part 52*b* (refer to FIG. 26 as well) provided on the side opposite the sticking part 52*a* of the switching member 52 using a finger. With this arrangement, the leading edge part 80*a* of the leader tape 80 stuck to the sticking part 52*a* is made to approach and come in close contact with the above described center area of the adhesive tape 150" with print. At this time, the flat plate part 52*b* comprises a width-direction dimension that is greater than the width of the leader tape 80 with the leading edge part 80*a* stuck to the sticking part 52*a*, enabling the operator to press the flat plate part 52*b* using a finger without contacting the leader tape 80.

Subsequently, as shown in FIG. 28, the operator switches the switching member 52 to the separated position (the state of FIG. 29) by pressing the sticking part 52*a* of the switching member 52 from above the above described center area of the adhesive tape 150" with print using a finger. At this time, the above described center area of the adhesive tape 150" with print pressed to the leader tape 80 side bends to the leader tape 80 side and adheres to the leading edge part 80*a* of the leader tape 80 by the adhesive of the center area. With this arrangement, the leader tape 80 and the adhesive tape 150" with print are connected. Further, at this time, if the switching member 52 is designed to produce a noise when switched from the close contact position to the separated position, it is possible to notify the operator that the switching member 52 was switched from the close contact position to the separated position, in other words, that the leading edge part 80*a* of the leader tape 80 and the above described center area of the adhesive tape 150" with print are adhered.

Then, as shown in FIG. 29, the entire core member 40 that includes the paper core 44 rotates as previously described, causing the leading edge part 80*a* of the leader tape 80 to be separated from the above described convex parts 52*c* and 52*c*, pulled to the paper core 44 side, and sequentially wound around and layered on the outer periphery of the paper core 44, forming the second roll R2.

Advantages of this Embodiment

As described above, in this embodiment, the rear-side opening/closing part 8 comprises the two opening/closing covers (the first opening/closing cover 8*a* and the second opening/closing cover 8*b*). That is, the area above the front side of the first storage part 3 can be opened and closed by the first opening/closing cover 8*a*, and the area above the rear side of the first storage part 3 can be opened and closed by the second opening/closing cover 8*b* separately from the first opening/closing cover 8*a*. Accordingly, when the operator wants to check the behavior of the first roll R1 inside the above described first storage part 3, the operator may set only the second opening/closing cover 8*b* to an open state while leaving the first opening/closing cover 8*a* in a closed state. With this arrangement, the operator can visually check the state of the print-receiving adhesive tape 150 based on a simple operation without largely opening the entire first storage part 3.

On the other hand, the edge part 19 of the second opening/closing cover 8*b* receives a driving force from the outer peripheral part 18*a* of the first opening/closing cover 8*a* when the first opening/closing cover 8*a* is moved in the opening direction. Accordingly, when the operator wants to largely open the area above the first storage part 3 and store (or remove) the first roll R1, for example, the operator may manually operate only the first opening/closing cover 8*a* in the opening direction. With this arrangement, when the first opening/closing cover 8*a* is moved in the opening direction, the edge part 19 of the second opening/closing cover 8*b* receives a driving force from the outer peripheral part 18*a* of the first opening/closing cover 8*a*, causing the second opening/closing cover 8*b* to automatically move in the opening direction as well in tandem with the movement of the first opening/closing cover 8*a*. As a result, it is possible to set both the first opening/closing cover 8*a* and the second opening/closing cover 8*b* to open states, largely open the entire first storage part 3, and smoothly store (or remove) the first roll R1. Note that when the operator manually operates the first opening/closing cover 8*a* in the closing direction after storage (or removal), the applying force of the apply force member provided at the upper end of the rear side of the housing main body 2*a* causes the second opening/closing cover 8*b* to automatically move in the closing direction as well in tandem with the movement of the first opening/closing cover 8*a* in the closing direction. With this arrangement, it is possible to close substantially the entire area above the first storage part 3.

As described above, according to this embodiment, an operator can visually check the state of the first roll R1 inside the first storage part 3 based on a simple operation without deteriorating operability at the time of storage or removal of the first roll R1 into or from the first storage part 3.

Further, in particular, according to this embodiment, the pivot axis K3 of the first opening/closing cover 8*a* is further on the rear side than the roll center RO of the first roll R1, making it possible to reliably largely open the area above the first roll R1 inside the first storage part 3 by simply manually operating the first opening/closing cover 8*a* in the opening direction, setting both the first opening/closing cover 8*a* and the second opening/closing cover 8*b* to open states.

Further, in particular, according to this embodiment, of the pivot axis K3 of the first opening/closing cover 8*a*, the pivot axis K4 of the second opening/closing cover 8*b*, and the roll center RO of the first roll R1 stored in the first storage part 3, the pivot axis K4 of the second opening/closing cover 8*b* is in the highest position. As a result, the space above the first storage part 3 that is opened and closed by the second opening/closing cover 8*b* (in other words, the size of the second opening/closing cover 8*b* itself) can be made as small as possible, making it possible for the operator to reliably visually check the state of the first roll R1 based on a simple operation.

Further, in this embodiment, the left and right pair of handle parts 25 and 25 is provided, each to the respective left or right side of the connecting arm 16 that connects the first roll R1 and the third roll R3. With this arrangement, the operator can lift the adhesive tape cartridge TK by gripping the handle parts 25 and 25 from both sides using the left hand and the right hand with the first roll R1 and the third roll R3 positioned in the front-rear direction as viewed from the operator. Since the adhesive tape cartridge TK can be handled with the two rolls (the first roll R1 and the third roll R3) set in the front-rear direction in this manner, regardless of the state of the weight balance between the first roll R1 side and the third roll R3 side as described above, it is possible to make handling performance less susceptible to the effects of weight balance. Then, further, according to this embodiment, the slip preventing parts 25*a* and 25*a* are provided at the ends of the rear side of the above described handle parts 25 and 25. With this arrangement, the operator can pinch the slip preventing parts 25*a* and 25*a* between the fingertips of both hands for support, making it possible to grip the handle parts 25 and 25 in their entirety using the left and right hands while preventing fingertip slipping.

As a result of the above, an operator can grip the adhesive tape cartridge TK of this embodiment favorably and reliably regardless of the length of the history of usage, thereby improving handling performance.

Further, in particular, according to this embodiment, the operator can grip the handle parts 25 and 25 that respectively protrude in the left-right direction from the left and right pair of first bracket parts 20 and 20 that hold the first roll R1 using the left and right hands, respectively, and lift the adhesive tape cartridge TK. As a result, it is possible to reliably improve the handling performance of the adhesive tape cartridge TK.

Further, in particular, according to this embodiment, the first connecting part 22 is disposed further on the radial outside than the slip preventing parts 25*a* and 25*a*. With this arrangement, it is possible to set the position of the first connecting part 22, which is provided at prevent interference with the outer diameter of the first roll R1, on the radial outside to the extent possible. As a result, the maximum outer diameter of the first roll R1 can be further increased, making it possible to increase the length of the print-receiving adhesive tape 150 that can be fed out from a single adhesive tape cartridge TK.

Further, in particular, according to this embodiment, the slip preventing parts 25*a* and 25*a* are configured so that the dimension along the radial direction of the first roll R1 is greater than the dimensions of the other areas of the handle parts 25 and 25. With the areas of the handle parts 25 and 25 that are larger than the other areas set as the slip preventing parts 25*a* and 25*a*, it is possible to reliably improve the ease of gripping and insusceptibility to slipping for the operator.

Further, in particular, according to this embodiment, the slip preventing parts 25*a* and 25*a* are partially arcuate in shape, making it possible to reliably maintain a state in which the slip preventing parts 25*a* and 25*a* are pinched by the fingertips of both hands even if the angle of inclination of the adhesive tape cartridge TK differs according to the length of the history of usage as previously described, thereby maintaining favorable handling performance.

Further, in particular, according to this embodiment, the first roll R1 winds the print-receiving adhesive tape 150. Further, the third roll R3 winds the separation material layer 151 peeled from the adhesive tape 150' with print. With this arrangement, it is possible to realize a configuration in which the operator can favorably and reliably grip the adhesive tape cartridge TK that is used after the separation material layer 151 is peeled as the print-receiving adhesive tape 150 is fed out, regardless of the length of the history of usage.

Further, in this embodiment, the head cover part 27*b* is pivotably provided around the pivot axis K7 near the print head 11, making it switchable between a covering position in which it covers the platen roller 12 side of the aforementioned print head 11 and an exposing position in which it exposes the platen roller 12 side. Then, depending on whether or not a force produced due to the relative approaching movement of the aforementioned platen roller 12 and the print head 11 is received by the edge parts 271 and 271 of the side plate parts 27*a* and 27*a*, the head cover part 27*b* is selectively pivoted to the above described covering position or the above described exposing position.

With this arrangement, when the platen roller 12 and the print head 11 are relatively near each other, the head cover part 27*b* pivots to the exposing position, making the aforementioned print formation movement possible. On the other hand, when the platen roller 12 and print head 11 are relatively separated from each other, the head cover part 27*b* pivots to the covering position, making it possible to cover and protect the platen roller 12 side of the print head 11.

As described above, according to this embodiment, it is possible to not obstruct the print formation movement when the movement is executed, and cover and reliably protect the print head 11 when the print formation movement is not performed.

Further, in particular, according to this embodiment, the edge parts 271 and 271 of the side plate parts 27*a* and 27*a* are configured to be capable of receiving a force from the shaft part 12*a* of the platen roller 12 that is produced due to the relative approaching movement of the platen roller 12 and the print head 11. With this arrangement, when the platen roller 12 and the print head 11 are relatively near each other, the head cover part 27*b* pivots to the exposing position due to the force received from the shaft part 12*a* of the approaching platen roller 12, making the above described print formation movement possible. On the other hand, when the platen roller 12 and print head 11 are relatively separated from each other, the head cover part 27*b* no longer receives the force from the above described shaft part 12*a* and pivots to the covering position, making it possible to cover and protect the platen roller 12 side of the print head 11. Further, the edge parts 271 and 271 receive the force from the shaft part 12*a* of the platen roller 12 and, with that force received from the shaft part 12*a*, the pivoting of the head cover part 27*b* is executed. With this arrangement, the head cover part 27*b* provided around the print head 11 is capable of promptly pivoting to the exposing position or the covering position in a manner that most directly corresponds to the approaching or separating behavior of the print head 11 with respect to the platen roller 12.

Further, in particular, according to this embodiment, the housing 2 comprises the housing main body 2*a* where the platen roller 12 is provided, and the first opening/closing arm 6 connected to the housing main body 2*a* in an openable and closeable manner. Then, the edge parts 271 and 271 of the side plate parts 27*a* and 27*a* are configured to be capable of receiving a force from the shaft part 12*a* of the platen roller 12 that is produced due to the mutual approach between the platen roller 12 and the print head 11 based on the opening/closing movement of the first opening/closing arm 6. Then, the head cover part 27*a* pivots to the exposing position when the edge parts 271 and 271 receive a force from the shaft part 12*a* of the platen roller 12 as the first opening/closing arm 6 changes to a closed state, and to the covering position when the edge parts 271 and 271 do not receive a force from the shaft part 12*a* of the platen roller 12 as the first opening/closing arm 6 changes to an open state. With this arrangement, when the operator sets the first opening/closing arm 6 to a closed state, it is possible to make the print head 11 approach the platen roller 12 and, due to the force received by the edge parts 271 and 271 of the side plate parts 27*a* and 27*a* at that time of that approach, pivot the head cover part 27*b* to the exposing position. On the other hand, when the operator sets the first opening/closing arm 6 to an open state, it is possible to make the print head 11 separate from the platen roller 12 and, since the above described force received from the shaft part 12*a* no longer exists, pivot the head cover part 27*b* to the covering position. Thus, it is possible to automatically switch the head cover part 27*b* from the covering position to the exposing position in tandem with the opening/closing movement of the first opening/closing arm 6.

Further, in particular, according to this embodiment, the space that is produced between the ribbon take-up roller 15 and the print head 11 provided for the guidance of the ink ribbon IB is utilized as a space for the pivoting movement of the head cover part 27*b*. With this arrangement, it is possible to maintain a space where the head cover part 27*b* recesses in the exposing position without causing unnecessary increases in size, and achieve smooth pivoting of the head cover part 27*b*.

Further, in this embodiment, when the user pivots the support bracket RB from the above described closed position to the above described open position, the second bracket RB2 moves in the direction of separation from the first bracket RB1, making the second roll R2 detachable in the open position. Accordingly, after the adhesive tape 150" with print is wound to form the second roll R2 as previously described, for example, the user can pivot the support bracket RB to the open position at suitable timing, and smoothly and simply remove the wound second roll R2 from the space between the first bracket RB1 and the second bracket RB2 separated as described above.

On the other hand, when the user pivots the support bracket RB from the above described open position to the above described closed position, the second bracket RB2 moves in the direction of approaching the first bracket RB1, making the second roll R2 not detachable in the closed position. Accordingly, when the second roll R2 is newly mounted, for example, the user disposes the second roll R2 (or the core member 40 for forming the second roll R2) in the space between the first bracket RB1 and the second bracket RB2 separated in the above described open position, and then pivots the support bracket RB to the closed position. With this arrangement, the second bracket RB2 is made to approach the first bracket RB1, making it possible to smoothly and simply sandwich and mount the above described second roll R2 (or the core member 40) between the two.

As described above, in this embodiment, the user can set the support bracket RB in the closed position, making it possible mount or remove the second roll R2 outside rather than inside the internal space of the housing main body 2*a*. With this arrangement, it is no longer necessary to maintain a manual operation space for mounting and removing the second roll R2 inside the housing main body 2*a*, making it possible to decrease the size of the housing main body 2*a*. Then, at this time, with a one-touch operation that pivots the support bracket RB from a closed position to an open position (or from an open position to a closed position), the user can make the second bracket RB2 approach or separate from the first bracket RB1 in tandem with that pivoting. With this arrangement, it is possible to simply and easily remove and mount the second roll R2 and thus improve operability.

Further, in particular, according to this embodiment, after disposing the second roll R2 (or the above described core member 40) between the first bracket RB1 and the second bracket RB2 in the separated state, the user pivots the support bracket RB from an open position to a closed position. As a result, due to the force received by the inclined cam part 35 from the wall part 36 of the housing main body 2*a*, a force such as one that resists the applying force of the compression spring 34 acts on the second bracket RB2. With this arrangement, it is possible to make the second bracket RB2 reliably approach the first bracket RB1 in tandem with the pivoting movement from the closed position to the open position.

Further, in particular, according to this embodiment, a gear mechanism for transmitting a driving force for rotationally driving the second roll R2 produced by the take-up motor M3 is provided at the front side of the housing main body 2*a*. Then, the first bracket RB1 is configured to be capable of transmitting the driving force from the above described gear mechanism to the second roll R2 in the closed position, and the inclined cam part 35 is provided at the second bracket RB2 on the side opposite the first bracket RB1. With this arrangement, it is possible to transmit the driving force from the take-up motor M3 to the second roll R2 via the first bracket RB1 by setting the support bracket RB in a closed position. As a result, it is possible to reliably take up and wind the adhesive tape 150" with print on the second roll R2. Further, the inclined cam part 35 is provided at the second bracket RB2, making it possible to have only the second bracket RB2 move in the left-right direction when the support bracket RB is pivoted, and the left-right direction position of the first bracket RB1 to be fixed. As a result, it is possible to not inhibit transmission of the driving force from the aforementioned gear mechanism to the first bracket RB1.

Further, in particular, according to this embodiment, when the support bracket RB pivots from the closed position and arrives at the open position, the concave part 39*b* provided at the edge of the circular part 31*b* of the second bracket RB2 engages with the protrusion 39*a* provided at the front side and the right side of the housing main body 2*a*, and the reinforcing plate 38 provided at the support bracket RB butts against the surface on the inside of the second opening/closing arm 7, thereby preventing the support bracket RB from pivoting any further. With this arrangement, it is possible to reliably prevent the occurrence of bending, damage, and the like on the first bracket RB1 and the second bracket RB2 due to excessive pivoting from the closed position.

Further, in this embodiment, the opening 480 is provided at the second flange part 48. At this time, the opening 480 comprises a radial dimension from the first radial position P1 to the second radial position P2 further on the inner peripheral side. Further, the second radial position P2 is set so that it is further on the inner peripheral side than the outer diameter of the paper core 44 mounted to the first cylinder part 45 and the second cylinder part 47.

With this arrangement, when the second roll R2 is generated as previously described, at least a part of the paper core 44 is exposed in the direction of the axis O2 via the above described opening 480 of the second flange part 48. As a result, even if the second roll R2 sticks to the second flange part 48 as previously described, the operator can peel the stuck area by pushing the above described exposed section outward with a fingertip, etc., and pull out the second roll R2 in the direction of the axis O2. Further, at that time, the opening 480 is provided at two locations radially facing each other on the second flange part 48, making it possible to substantially simultaneously press the two locations radially facing each other on the second roll R2. As a result, it is possible to smoothly and reliably pull out the second roll R2.

Further, in particular, according to this embodiment, the edge part 480*a* of the opening 480 on the radial inside is substantially set in the same position as the radial inside end of the second flange part 48, making it possible to increase the size of the opening 480 toward the radial inside. With this arrangement, it is possible to more reliably peel the second roll R2 from the second flange part 48 by the above described pushing outward via the openings 480.

Further, in particular, according to this embodiment, the opening 480 comprises a substantially trapezoidal shape with the length of the edge part 480*a* on the radial inside longer than the length of the edge part 480*b* on the radial outside. With this arrangement, it is possible to increase the size of the edge part 480*a* of the opening 480 on the radial inside, which exposes the paper core 44, and make the above described pushing outward easier and, at the same time, decrease the size of the edge part 480*b* on the opposite side on the radial outside to the extent possible to maintain the strength of the second flange part 48, making it possible to guide the position of the pushing outward performed by the fingertip in the edge part 480*a* direction.

Further, in this embodiment, the adhesive holding part 51 is provided in order to temporarily tack the adhesive layer 152 that is exposed on the above described adhesive tape 150" with print when the adhesive tape cartridge TK is handled as a single unit prior to mounting to the housing main body 2*a*. The user adheres the above described generated adhesive tape 150" with print (specifically, both side areas) to the above described adhesive holding part 51. With this arrangement, when the adhesive tape cartridge TK is handled as a single unit as described above, it is possible to prevent the adhesive tape 150" with print from mistakenly sticking to the third roll R3 or another part of the adhesive tape cartridge TK.

At this time, in preparation for cases where the above described adhesive tape cartridge TK is mounted to the housing main body 2*a* as previously described and generation of the second roll R2 is to be started, the above described adhesive holding part 51 holds the above described adhesive layer 152 with the center area other than the above described both side areas exposed in the air. With this arrangement, the user can set the leading edge 80*a* of the leader tape 80 installed to the outer peripheral side of the above described core member 40 near the above described center area exposed in the air, for example. Then, when the above described generation of the second roll R2 is started, the user makes the leading edge part 80*a* of the leader tape 80 set as described above approach and come in close contact with the center area of the above described adhesive tape 150" with print positioned nearby. With this arrangement, the adhesive tape printing device 1 rotationally drives the above described core member 40 and winds the leader tape 80 around the outer peripheral side thereof, for example, making it possible to wind the above described adhesive tape 150" with print connected to the leader tape 80 around the outer peripheral side of the above described core member 40 following the leader tape 80 and generate the second roll R2.

As described above, in this embodiment, it is possible to simplify and streamline the preparation operation performed when the adhesive tape cartridge TK is mounted to the housing main body 2*a* and generation of the second roll R2 is to be started, thereby decreasing the labor burden.

Further, in particular, according to this embodiment, the adhesive holding part 51 holds both side areas of the adhesive layer 152 by the adhesive receiving parts 51*b* and 51*b* with the center area of the adhesive layer 152 held and exposed in the air by the concave part 51*a*. At this time, the concave part 51*a* is configured to be capable of receiving the leading edge part 80*a* of the above described leader tape 80. With this arrangement, the user sets the leading edge part 80*a* of the leader tape 80 installed to the outer peripheral side of the core member 40 to the inside of the concave part 51*a*, which is near the above described center area exposed in the air, making the set leading edge part 80*a* of the leader tape 80 come in close contact with the center area of the above described adhesive tape 150" with print. As a result, it is possible to reliably connect the leader tape 80 and the adhesive tape 150" with print and wind the connected above described adhesive tape 150" with print around the outer peripheral side of the core member 40.

Further, in particular, according to this embodiment, the switching member 52 capable of switching and moving between a separated position in which the adhesive tape 150" with print is separated from the leader tape 80, and a close contact position in which the adhesive tape 150" with print and the leader tape 80 are in close contact is provided at the above described concave part 51*a*. The user sticks the leading edge part 80*a* of the above described leader tape 80 to the switching member 52 set to the separated position in advance, and then switches the above described switching member 52 to the close contact position. With this arrangement, it is possible to make the above described stuck leading edge part 80*a* of the leader tape 80 approach and come in close contact with the center area of the above described adhesive tape 150" with print. As a result, it is possible to smoothly and reliably connect the leader tape 80 and the adhesive tape 150" with print based on a simple operation.

Note that the present disclosure is not limited to the above described embodiment, and various modifications may be made without deviating from the spirit and scope of the disclosure. For example, while the inclined cam part 35 is provided at the second bracket RB2 side in the above described embodiment, the present disclosure is not limited thereto, allowing an inclined cam part to be provided at the first bracket RB1 side rather than (or in addition to) the second bracket RB2 side. In this case as well, similar advantages to those of the above described embodiment can be achieved.

Further, while the compression spring 34, the inclined cam part 35, and the like are provided at the support bracket RB, causing the second bracket RB2 to move in the direction of separation from the first bracket as the support bracket RB pivots from the closed position toward the open position, and causing the second bracket RB2 to move in the direction of approaching the first bracket as the support bracket RB pivots from the open position to the closed position in the above described embodiment, the present disclosure is not limited thereto. For example, at least one member that acts as described above may be provided at the housing main body 2*a* side rather than (or in addition to) the support bracket RB side. In this case as well, similar advantages to those of the above described embodiment can be achieved.

Further, while the second bracket RB2 is capable of moving in the left-right direction and the left-right direction position of the first bracket RB1 is fixed in the above described embodiment, the present disclosure is not limited thereto, allowing the first bracket RB1 to be capable of moving in the left-right direction and the left-right direction position of the second bracket RB2 to be fixed. Or, both the first bracket RB1 and the second bracket RB2 may be capable of moving in the left-right direction. In this case as well, similar advantages to those of the above described embodiment can be achieved.

Further, while the second roll R2 that winds the adhesive tape 150" with print on which print was formed by the print head 11 and from which the separation material layer 151 was peeled around the axis O2 is formed in the above described embodiment, the present disclosure is not limited thereto. For example, a second roll that winds the adhesive tape 150' with print on which print was formed by the print head 11 and from which the above described peeling was not performed around the axis O2 may be formed. In this case as well, similar advantages to those of the above described embodiment can be achieved.

Further, while the paper core 44 is mounted to the outer peripheral side of the first outer cylinder 42 and the second outer cylinder 43, and the adhesive tape 150" with print is wound around the outer peripheral side of the paper core 44 in the above described embodiment, the present disclosure is not limited thereto. For example, a dedicated cylindrical member (winding cylinder) may be fixed to the outer peripheral side of the first outer cylinder 42 and the second outer cylinder 43, and the adhesive tape 150" with print may be wound around the outer peripheral side of the dedicated cylindrical member. Note that, in this case, the dedicated cylindrical member is fixed by a suitable fixing method. In this case as well, similar advantages to those of the above described embodiment can be achieved.

Further, while the above described embodiment has described an illustrative scenario in which the present disclosure is applied to the adhesive tape printer 1 that performs printing on the print-receiving adhesive tape 150, the present disclosure is not limited thereto, allowing application to a tape take-up apparatus that takes up and layers an affixing tape comprising a base layer and an adhesive layer to generate an affixing tape roll as well.

Further, other than that already stated above, techniques based on the above described embodiment and each of the modifications may be suitably utilized in combination as well.

What is claimed is:

1. A tape cartridge comprising:

a first tape roll around which a first tape consumed by feed-out is wound about an axis extending along a first direction;

a second tape roll configured to wind a second tape around an axis extending along said first direction and provided on a downstream side of said first tape roll along a second direction substantially orthogonal to said first direction, the second tape generated by a feeding of said first tape fed out from said first tape roll along said second direction;

a connecting part that is provided so as to connect said first tape roll and said second tape roll, and configured to rotatably support said first tape roll on one side in said second direction, and rotatably support said second tape roll on an other side spaced from the first side in said second direction; and a pair of gripped parts that extends along said second direction in a section of said connecting part on said one side in said second direction, each of said gripped parts being respectively provided on opposite sides of said connecting part along said first direction, each of said gripped parts comprising a slip preventing part configured to prevent slipping during gripping on an end of the gripped part in said one side along said second direction, said connecting part comprising:

a pair of first bracket parts configured to sandwich and rotatably hold said first tape roll between one side and the other side along said axis extending along said first direction, and provided on said one side in said second direction;

a first connecting part that extends substantially along said first direction so as to connect upper ends of said pair of first bracket parts while preventing interference with an outer diameter of said first tape roll;

a pair of second bracket parts configured to sandwich and rotatably hold said second tape roll between one side and the other side along said axis extending along said first direction, provided on said other side of said second direction;

a second connecting part that extends substantially along said first direction so as to connect upper ends of said pair of second bracket parts;

a third connecting part that connects, along said first direction, ends of said pair of gripped parts on said other side of said second direction, and fourth connecting parts that respectively connect, along a third direction substantially orthogonal to both of said first direction and said second direction, an end of said first connecting part in the first direction to said third connecting part, wherein said gripped parts are provided so as to respectively protrude outward along said first direction from said pair of first bracket parts, and said third connecting part lies on said other side of said second direction than said first connecting part.

2. The tape cartridge according to claim 1, wherein:

said slip preventing part is disposed so that a position in a radial direction of said first tape roll is inner along the radial direction than said first connecting part.

3. The tape cartridge according to claim 1, wherein:

said slip preventing part is configured so that a dimension along a radial direction of said first tape roll is greater than dimensions of other areas of said gripped part along the radial direction.

4. The tape cartridge according to claim 3, wherein:

said slip preventing part has a substantially partially arcuate shape as viewed from said first direction.

5. The tape cartridge according to claim 1, wherein:

said first tape roll is an adhesive tape roll configured to wind an adhesive tape as said first tape, the adhesive tape including an adhesive layer and an separation material layer that covers said adhesive layer; and said second tape roll is a separation material roll configured to wind said separation material layer peeled from said adhesive tape fed out from said first tape roll and fed.

* * * * *